US010744777B2

(12) United States Patent
White et al.

(10) Patent No.: US 10,744,777 B2
(45) Date of Patent: Aug. 18, 2020

(54) MODIFYING CONFIGURATION INFORMATION OF AN INKJET CARTRIDGE

(71) Applicant: Retail Inkjet Solutions, Inc., Carlsbad, CA (US)

(72) Inventors: Kraig David White, San Diego, CA (US); Chris Alan Stratford, Valley Center, CA (US); Juan Manuel Jimenez, Escondido, CA (US)

(73) Assignee: Retail Inkjet Solutions, Inc., Carlsbad, CA (US)

( * ) Notice: Subject to any disclaimer, the term of this patent is extended or adjusted under 35 U.S.C. 154(b) by 0 days.

(21) Appl. No.: 16/826,839

(22) Filed: Mar. 23, 2020

(65) Prior Publication Data

US 2020/0215823 A1 Jul. 9, 2020

Related U.S. Application Data

(62) Division of application No. 15/947,531, filed on Apr. 6, 2018, now Pat. No. 10,596,818.

(60) Provisional application No. 62/491,155, filed on Apr. 27, 2017.

(51) Int. Cl.
*B41J 2/175* (2006.01)

(52) U.S. Cl.
CPC ..... *B41J 2/17506* (2013.01); *B41J 2/1752* (2013.01); *B41J 2/17513* (2013.01); *B41J 2/17546* (2013.01); *B41J 2/17559* (2013.01)

(58) Field of Classification Search
CPC ..... B41J 2/17506; B41J 2/17546; B41J 2/17559; B41J 2/17513; B41J 2/1752
See application file for complete search history.

(56) References Cited

U.S. PATENT DOCUMENTS

| | | | | |
|---|---|---|---|---|
| 7,089,973 | B2 * | 8/2006 | Nicodem | B41J 2/17506 141/18 |
| 7,540,597 | B2 * | 6/2009 | Guhse | B41J 2/17506 347/84 |
| 7,883,188 | B2 * | 2/2011 | Scanlan | B41J 2/17506 347/85 |
| 7,946,316 | B2 * | 5/2011 | Sarnoff | B41J 2/17506 141/329 |
| 8,602,536 | B1 * | 12/2013 | Sarnoff | B41J 2/17506 347/85 |
| 2005/0034777 | A1 * | 2/2005 | Nicodem | B41J 2/17506 141/2 |
| 2018/0311962 | A1 * | 11/2018 | White | B41J 2/17546 |

* cited by examiner

*Primary Examiner* — Huan H Tran
(74) *Attorney, Agent, or Firm* — Knobbe, Martens, Olson & Bear, LLP

(57) ABSTRACT

Embodiments provide a modular inkjet configuration modification system and method for use in modifying electronics, such as a PLC, on a remanufactured or refilled inkjet cartridge. The modular system can include a receiver and one or more interchangeable adapters. The interchangeable adapters can include structures and geometry which allow each of the interchangeable adapters to be used with the receiver and swapped by an operator on an as-needed basis.

6 Claims, 11 Drawing Sheets

MODIFYING CONFIGURATION INFORMATION OF AN INKJET CARTRIDGE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

This application is a divisional of U.S. patent application Ser. No. 15/947,531 entitled "SYSTEMS AND METHODS FOR RESETTING AN INKJET CARTRIDGE" filed on Apr. 6, 2018, which claims benefit of U.S. provisional application Ser. No. 62/491,155 entitled "SYSTEMS AND METHODS FOR RESETTING AN INKJET CARTRIDGE" filed on Apr. 27, 2017. Each of these applications are hereby incorporated by reference herein in their entireties.

BACKGROUND

Field

This disclosure relates to systems and methods for refilling inkjet cartridges. More specifically, this disclosure relates to systems and methods for resetting an inkjet cartridge, such as modifying electronics of an inkjet cartridge.

Background

In the personal and business computer market, inkjet printers are very common. Inkjet printers are inexpensive, quiet, fast and produce high quality output. However, replacement cartridges can be expensive. Although some manual inkjet refilling kits are available, they can be difficult and messy for individuals to use, and inkjet cartridges may become damaged during the refilling task, especially when performed by inexperienced users. Moreover, many inkjet cartridges use programmable logic chips (PLCs) to control ink usage and other parameters of the inkjet cartridge and to properly identify an inkjet cartridge to the inkjet printer. A PLC is an electronic device that resides on an inkjet cartridge and communicates information, generally bi-directionally, with the inkjet printer and stores and provides data about the inkjet cartridge and inkjet cartridge status to and from the inkjet printer. Resetting such PLCs enables the inkjet cartridge to be refilled with ink (e.g., when empty) and, with this PLC having been reset, to perform substantially the same as a new cartridge.

Original equipment manufacturers (OEMs) of printer and imaging products, such as Lexmark®, Canon®, Hewlett Packard® and the like, make replacement inkjet cartridges that fit their respective inkjet printers. Generally, a unique PLC is developed for each specific model and color of inkjet cartridge. Additionally, the placement of these PLCs and the geometry of each of inkjet cartridge differ among various cartridges, even among the same OEMs. As such, in a retail store environment for refilling inkjet cartridges, this variation in PLCs and geometry of cartridges requires a substantial number of PLC resetting or reprogramming devices which generally operate separately from the inkjet refilling system.

SUMMARY

Example embodiments described herein have several features, no single one of which is indispensable or solely responsible for their desirable attributes. Without limiting the scope of the claims, some of the advantageous features will now be summarized. While the features and structures are described below in connection with embodiments of inkjet cartridges such as inkjet cartridges having an integrated printhead and inkjet cartridges for use with inkjet printers having a printhead, it is to be understood that the features and structures can be implemented in any ink or toner source capable of being replaced or refilled (e.g., a laser toner cartridge for use with a laser printer, LED printed supplies for use with an LED printer, etc.) as well as any other consumable having programmable or resettable electronics. After considering this discussion, and particularly after reading the section entitled "Detailed Description" one will understand how the features of the embodiments described herein provide advantages that include more efficient and environmentally friendly refilling of inkjet cartridges.

In some embodiments, a modular system can modify an inkjet cartridge configuration. The modular system can include a receiver having one or more docking regions comprising electrical interfaces. The modular system can include a first adapter configured to establish communications between a first type of inkjet cartridge and the receiver. The first adapter can include a base, a receiver interface which can contact an electrical interface of the receiver, and/or a cartridge interface which can contact electronics of a first type of inkjet cartridge. The modular system can include a control system. The control system can determine a type of inkjet cartridge based on at least one of: a type of adapter, and electronics of the inkjet cartridge. The control system can modify configuration information stored on the inkjet cartridge based on the determined type of inkjet cartridge.

In some embodiments, the system further can include a second adapter which can establish communications between a second type of inkjet cartridge and the receiver. The second adapter can include a base, a receiver interface which can contact an electrical interface of the receiver, and/or a cartridge interface which can contact electronics of the second type of inkjet cartridge. In some embodiments, the receiver can include a first docking region and a second docking region. In some embodiments, the first adapter can communicate with the receiver at the first docking region and the second adapter can communicate with the receiver at the second docking region. In some embodiments, the first adapter and the second adapter can interchangeably communicate with the receiver at the same docking region.

In some embodiments, the first adapter can include a support structure. The first type of inkjet cartridge can removably couple with the support structure. In some embodiments, the support structure can be removably coupled to a recess of the base. The support structure can include a first sidewall. The support structure can also include a second sidewall spaced apart from the first sidewall.

In some embodiments, the first adapter can include a retention mechanism which can removably couple with a docking region. In some embodiments, the retention mechanism can include a plug which can removably couple with a socket of the receiver. The socket can include the electrical interface of a docking region of the receiver. In some embodiments, the retention mechanism can include a hook configured to engage a lip in the docking region. The lip can be moved from an engaged configuration to a disengaged configuration. The lip can be biased towards the engaged configuration.

In some embodiments, the first adapter can include electronics provided within the base of the first adapter. The electronics can include programmed instructions that, when executed by the control system, modify configuration information stored on the inkjet cartridge based on the determined type of inkjet cartridge. The electronics can include an identification tag such that the control system can determine the type of adapter attached to the receiver.

In some embodiments, the system can include a user interface. The control system can display programming information based on the determined type of inkjet cartridge. The programming information can include credits for modifying configuration information stored on the inkjet cartridge.

In some embodiments, the system can include a fill station which can refill an inkjet cartridge. In some embodiments, the receiver can be attached to the fill station.

In some embodiments, a method for modifying configuration information stored on an inkjet cartridge is provided. The method can be utilized in connection with a modular system having a receiver and one or more interchangeable adapters. The method can include detecting a first electronic coupling between an interchangeable adapter and the receiver. The method can include detecting a second electronic coupling between an inkjet cartridge and the interchangeable adapter. The method can include determining a type of the inkjet cartridge based on the first and second electronic couplings. The method can include modifying configuration information stored on the inkjet cartridge based on the determined type of inkjet cartridge.

In some embodiments, determining a type of inkjet cartridge comprises detecting an identification tag of the interchangeable adapter based on the first electronic coupling. In some embodiments, determining a type of inkjet cartridge comprises detecting identification information on electronics of the inkjet cartridge based on the second electronic coupling.

In some embodiments, the method can include determining credits based on the determined type of inkjet cartridge. In some embodiments, the method can include comparing the credits to a threshold amount prior to modifying the inkjet configuration. In some embodiments, the method can include displaying credits on a user interface.

BRIEF DESCRIPTION OF THE DRAWINGS

These and other features, aspects and advantages are described below with reference to the drawings, which are intended to illustrate embodiments of inkjet refilling systems including embodiments of various components of these inkjet refilling systems.

DETAILED DESCRIPTION

Figure 1:
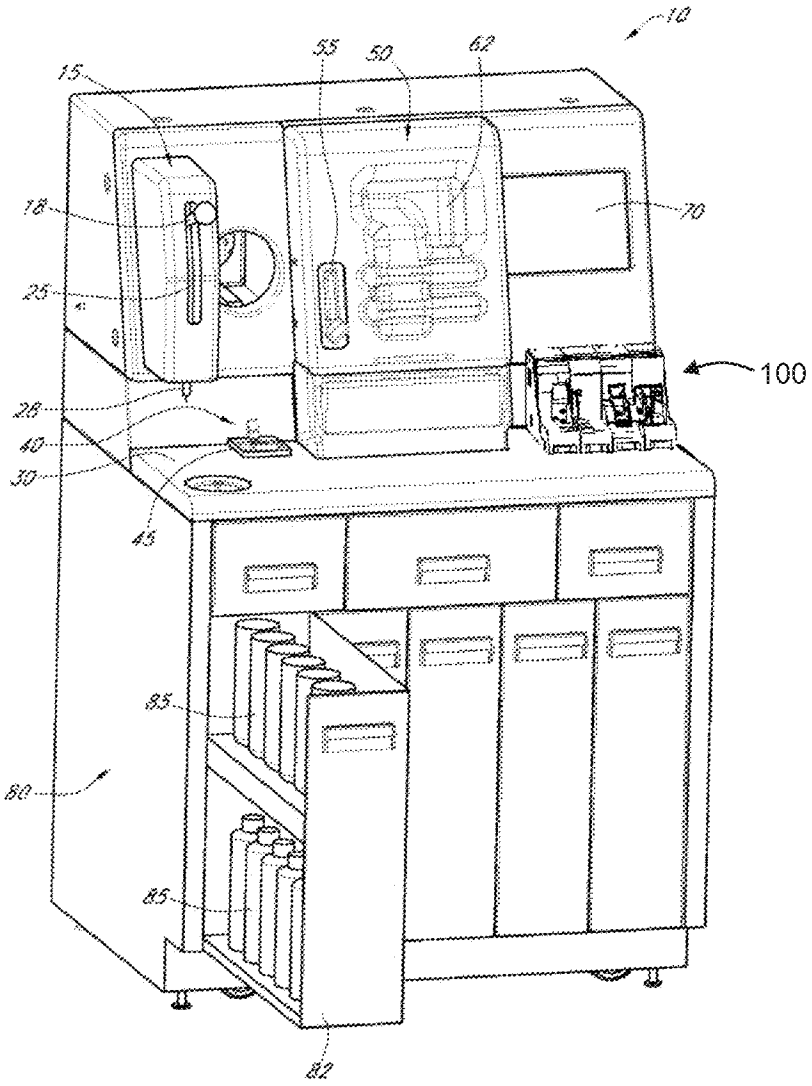
FIG. 1 is a front perspective view of an embodiment of an inkjet refilling system.

Certain terminology may be used in the following description for the purpose of reference only, and thus are not intended to be limiting. For example, terms such as "upper", "lower", "upward", "downward", "above", "below", "top", "bottom" and similar terms refer to directions in the drawings to which reference is made. Such terminology may include the words specifically mentioned above, derivatives thereof, and words of similar import. Similarly, the terms "first", "second", and other such numerical terms referring to structures neither imply a sequence or order unless clearly indicated by the context.

While the present description sets forth specific details of various embodiments, it will be appreciated that the description is illustrative only and should not be construed in any way as limiting. Additionally, although particular embodiments may be disclosed or shown in the context of particular types of printing systems, such as an inkjet printer and associated inkjet cartridges, it is to be understood that any elements of the disclosure may be used in any type of printing system such as, but not limited to, laser printers, LED printers, and associated ink or toner sources.

While the embodiments described herein include electrical interfaces which are described in connection with mechanical structures (e.g., contacts, pins, sockets, plugs, and the like) to establish a connection between various systems, it is to be understood that one or more of these interfaces can include structures which establish a connection wirelessly. For example, one or more of the interfaces can include transmitters, receivers, and/or transceivers which enable wireless communications such as NFC, Wi-Fi (i.e., 802.11 protocols), Bluetooth, and the like.

As used herein, the term "PLC" means any programmable storage that can be programmed by a user and maintains persistent storage without external power. For example, in one embodiment, the PLC generally takes the form of a small printed circuit assembly (PCA) or flexible electronic circuit that may, among other components, contain an application specific integrated circuit (ASIC) and/or an erasable programmable read only memory (EPROM) or the like. These forms of computer memory do not lose their contents when the power supply is removed, and can be easily erased and reused. EPROMs and the like are generally employed for programs designed for repeated use (such as a computer's Buffered Input/Output system (BIOS) but can be upgraded with a later version of the program or other data. ASICs are highly customized electronic circuits that perform a very specific function. In other embodiments, flash memory or a one-time programmable EPROM may be used. However, any type of PLC with persistent programmable memory may be suitable for the uses described herein.

The Inkjet Refilling System

With reference first to FIG. 1, an inkjet refilling system 10 is shown. As shown in the illustrated embodiment, the system can be a floor-standing unit. However, it is to be understood that the system can take on different form-factors, such as a desk-top unit. The system includes a drill station 15 having an actuator 18. In the embodiment shown, the actuator 18 comprises a handle on a lever. In this embodiment, an on/off switch activates the drill. Thus, when the lever is moved downward, the drill becomes active. A slide channel 25 allows the actuator to slide up and down as the drill is engaged with an inkjet cartridge.

A covered self-centering drill bit 28 protrudes from the lower portion of the drill station, and is connected to the actuator 18 so that movement of the actuator 18 within the slide channel 25 results in the covered drill bit 28 moving up and down. Beneath the covered drill bit 28 is a flat surface 30 where adapters or fixtures are placed containing inkjet cartridges or tanks to be drilled. Once a fixture has been placed on the flat surface 30 and aligned beneath the drill bit 28, any of several on/off switches, known in the art, can be used to activate the self-centering drill bit 28. The actuator 18 is then slid down within the slide channel 25 until the drill bit 28 drills a hole within the cartridge or tank. In one alternative embodiment, the drill mechanism may be configured such that the drill activates and begins to spin the drill bit as soon as the handle is lowered from the top of the spring-biased upper position in the slide channel 25. As used herein, the term "inkjet cartridge" means a typical cartridge having a print head, and also includes an inkjet tank that does not include an inkjet print head.

Adjacent the drilling station 15 is a cleaning station 40 which is configured to receive an inkjet cartridge and remove any excess ink from the cartridge prior to refilling. In this embodiment, the cleaning station 40 includes a mounting station 45 which is adapted to receive the plurality of the fixtures described above. A portion of the mounting station 45 includes an evacuation station that communicates with a vacuum source in order to evacuate the ink from any cartridge that is inserted into the mounting station 45.

Within a central portion 50 of the system 10 can include a nozzle refilling station 55 that is configured to receive an inkjet cartridge and refill that cartridge through its nozzles. As is known in the art, inkjet cartridges eject ink from a set of nozzles. In some cases it is possible to refill or clean inkjet cartridges by forcing ink or cleaning solutions into the cartridge through the nozzles. One example of such a cartridge is the Hewlett Packard Model HP45 inkjet cartridge. When the cartridge is placed within the nozzle refilling station 55, the system forces a predetermined quantity of ink into the cartridge through the nozzles. In some embodiments, the nozzle refilling station 55 also includes a vacuum source so that prior to nozzle filling the inkjet cartridge it can be evacuated to remove any unused ink. As shown, the central portion 50 can include a door 62 that seals a vacuum chamber when closed to allow a low pressure environment to be created by the vacuum source. In this manner the system knows the proper amount of ink to use in refilling the cartridge. In another embodiment, the nozzle refilling station 55 includes a wash solution source that can be used to rinse the interior of the cartridge prior to refilling. Wash solution may include sterile filtered water, or a cleansing solution adapted for cleaning inkjet cartridges.

Adjacent the central portion 50 is a user interface 70 which is used by the operator to control each step in the refilling process. In some embodiments, the user interface comprises a touch screen graphical user interface. However, it is to be understood that the user interface can include one or more visual displays and one or more input devices such as keypads. The user interface is linked to a central computer system (not shown) that controls all of the functions of the system 10. By inputting commands through the user interface 70, an operator can perform the functions described herein.

Within a lower portion 80 of the system 10 is a drawer 82 that provides a series of ink refill bottles 85. These bottles provide the source of ink used within the system to refill the inkjet cartridges.

Below the user interface 70 is a modular cartridge configuration system 100. The system 100 can be used to modify each inkjet cartridge before, during, or after it has been refilled so that the serviced inkjet cartridge can be usable when re-installed into a printer.

Modular Cartridge Configuration System

With reference next to FIGS. 2-14, an embodiment of a modular cartridge configuration system 100, or components thereof, is illustrated. As shown in the illustrated embodiment, the system 100 can be a self-contained unit which can be physically and/or electrically coupled to the inkjet refilling system 10. This can allow the modular cartridge configuration system 100 to be serviced separately from the inkjet refilling system 10 to minimize downtime of the inkjet refilling system 10. However, it is to be understood that the modular cartridge configuration system 100, or components thereof, can be built into the inkjet refilling system 10 itself.

The modular cartridge configuration system 100 can be used to modify an inkjet cartridge configuration. In some embodiments, the system 100 can be used to reset electronics, such as an original PLC or an existing customizable PLC, on an inkjet cartridge to ensure that the serviced inkjet cartridge is usable when replaced within an inkjet printer. For example, the system 100 can reset the PLC so that a cartridge having the PLC is recognized as being new or full by an inkjet printer. In some embodiments, the system 100 can be used to program electronics, such as a new customizable PLC, on an inkjet cartridge to ensure that the inkjet cartridge is compatible with an inkjet printer when the inkjet cartridge is replaced within the inkjet printer. For example, a customizable PLC could replace the original PLC on the inkjet cartridge. The system 100 can then program the customizable PLC to emulate the specific PLC SKU that would otherwise be used for the inkjet cartridge SKU that is being refilled. Examples of customizable PLC systems and methods of programming are described in further detail in U.S. Pat. No. 8,602,536 titled "Programming Customizable Smart-Chip in an Ink Refilling Station," issued Nov. 4, 2010, the entirety of which is incorporated herein by reference.

Figure 2:
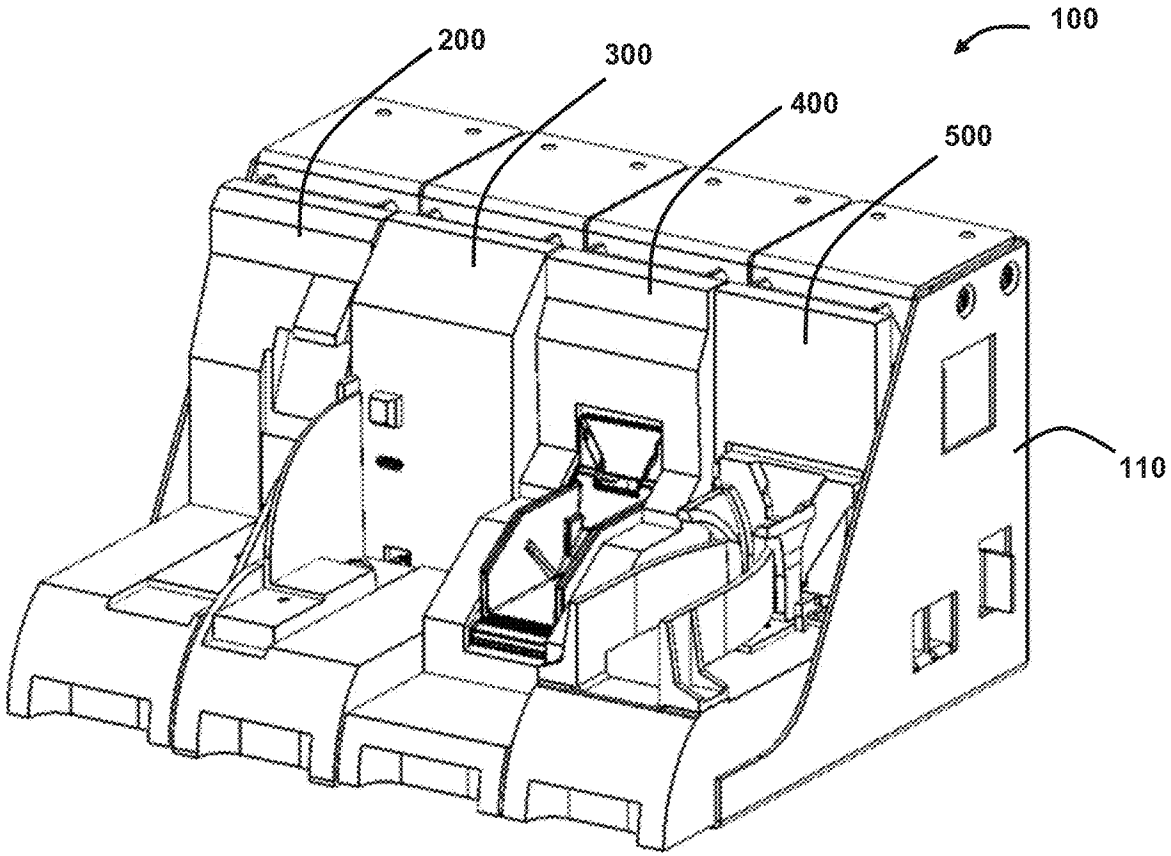
FIG. 2 is a front perspective view of an embodiment of a modular cartridge configuration system having a receiver with four interchangeable adapters attached thereto.

With reference first to FIG. 2 which illustrates a perspective view of the modular cartridge configuration system 100, the modular cartridge configuration system 100 can include a receiver 110 and one or more interchangeable adapters. The interchangeable adapters, such as adapters 200, 300, 400, 500, can allow the modular cartridge configuration system 100 to work with a variety of inkjet cartridge types. For example, each adapter can be sized and shaped to receive inkjet cartridges from a different family or series of inkjet cartridges (e.g., different manufacturers, different shapes of cartridges, and/or different sizes of cartridges). In some embodiments, the adapters, such as adapters 200, 300, 400, 500, can establish electrical communications between inkjet cartridges and the receiver 110. Moreover, the interchangeable adapters 200, 300, 400, 500 can allow the system 100 to be updated for use with newer types of inkjet cartridges which may not have been available at the time the system 100 was first put into use. As such, as new inkjet cartridges are developed, new interchangeable adapters can be manufactured to hold the new inkjet cartridge. This allows the system 100 to work with newly designed cartridges without resorting to alterations in the physical configuration of the system 100.

In the event that an inkjet cartridge to be serviced is incompatible with the existing interchangeable adapters 200, 300, 400, 500 coupled to the receiver 110, the operator can swap one of the existing interchangeable adapters 200, 300, 400, 500 with a different interchangeable adapter compatible with that particular type of inkjet cartridge. This reduces the amount of time needed to modify an inkjet cartridge configuration. Moreover, the small form factor of each of the interchangeable adapters facilitates organization and storage of such adapters which can further enhance efficiency of the operator.

While the embodiment of modular cartridge configuration system 100 illustrated in FIG. 2 includes four interchangeable adapters 200, 300, 400, 500, it is to be understood that the system 100 can be used with a fewer number of interchangeable adapters or a greater number of interchangeable adapters. In some embodiments, the system 100 can include one interchangeable adapter to provide for a more compact configuration while still allowing an operator to swap interchangeable adapters. The interchangeable adapters can be swapped out on an as-needed basis based on the type of inkjet cartridge being serviced.

Receiver

Figure 3:
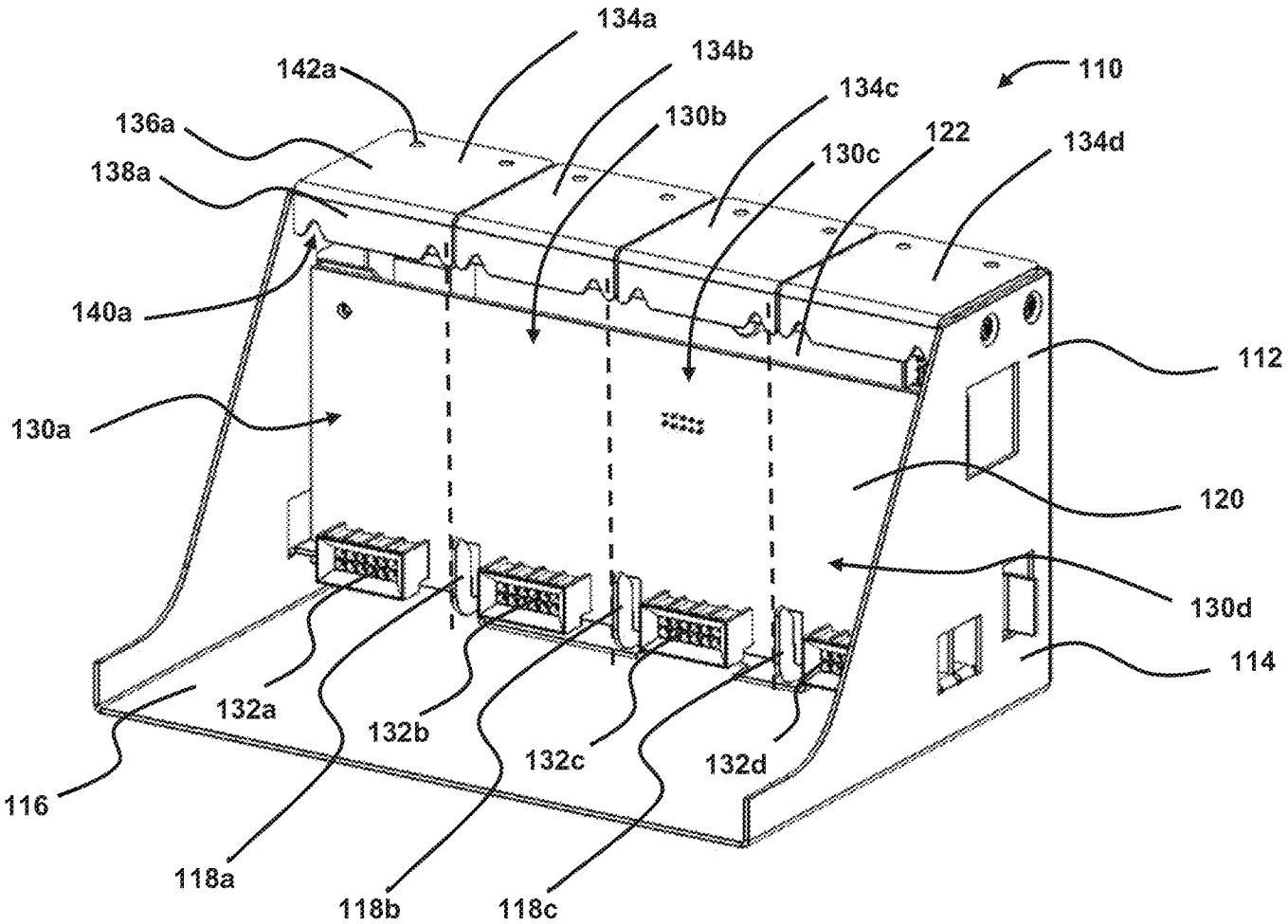
FIG. 3 is a front perspective view of the receiver of FIG. 2 shown without the interchangeable adapters in place.
Figure 4:
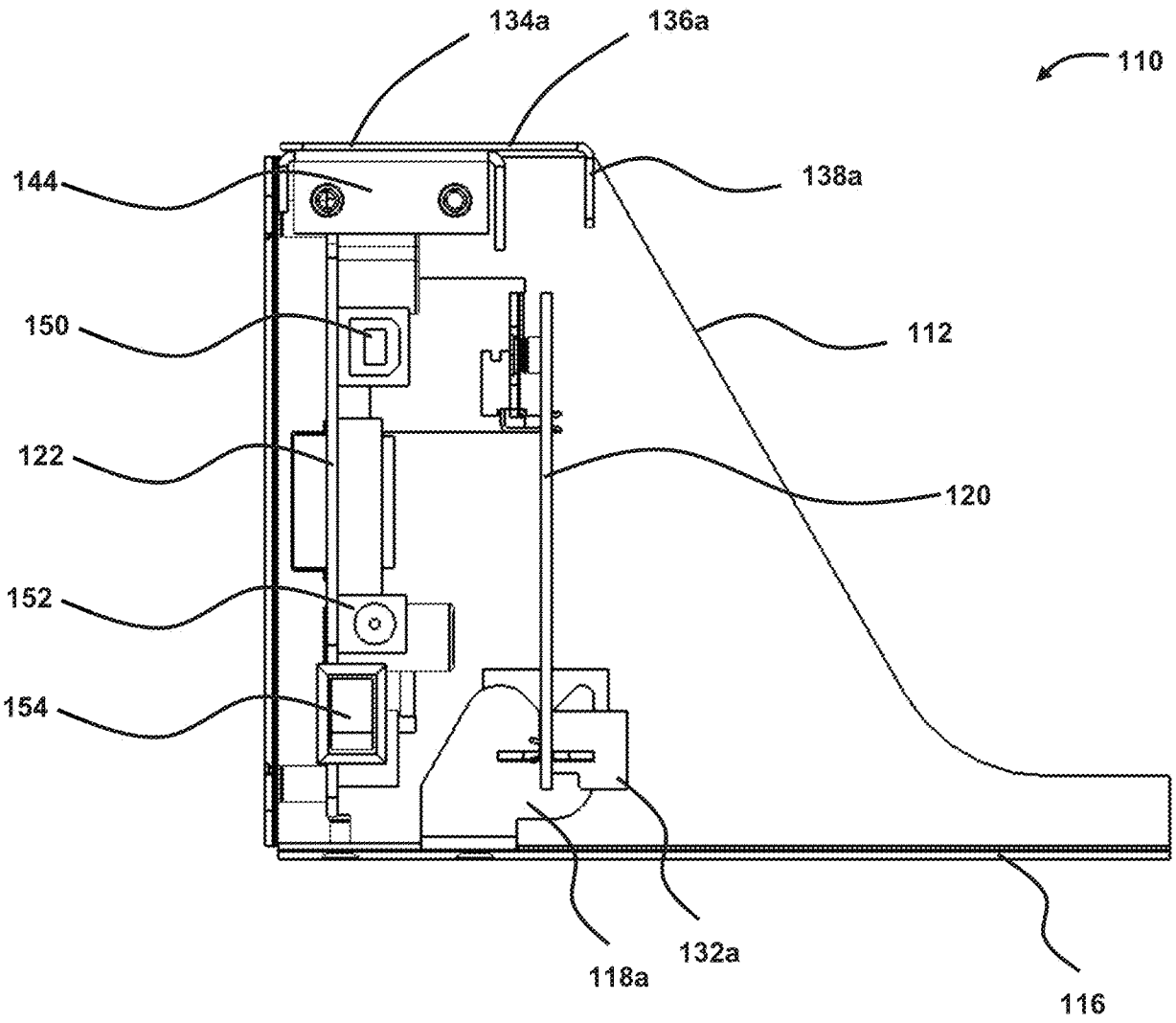
FIG. 4 is a left-side elevation view of the receiver of FIG. 3, with a side wall of the receiver removed to illustrate internal components.

With reference next to FIGS. 3 and 4, the receiver 110 is illustrated without interchangeable adapters attached thereto. FIG. 3 illustrates a perspective view of the receiver 110, including a frame 112 having vertically-oriented side walls 114, a horizontally-oriented floor 116, and/or one or more support tabs 118*a*, 118*b*, 118*c*. The frame 112 can be used to support various components of the receiver 110, such as circuit board 120. As shown in the illustrated embodiment, circuit board 120 is supported at least by the one or more support tabs 118*a*, 118*b*, 118*c* along a lower edge of the circuit board 120.

The receiver 110 can include four docking regions 130*a*, 130*b*, 130*c*, 130*d* which have been illustrated with dash-dash broken lines. These docking regions are regions of the receiver 110 into which interchangeable adapters can be positioned or received. As shown in the illustrated embodiment, the docking regions 130*a*, 130*b*, 130*c*, 130*d* can have similar geometry to allow each of the docking regions 130*a*, 130*b*, 130*c*, 130*d* to be interchangeably used with interchangeable adapters. For example, the positioning of interchangeable adapters 200, 300, 400, 500 as shown in FIG. 2 can be swapped between different docking regions as desired by an operator. However, it is to be understood that one or more of the docking regions 130*a*, 130*b*, 130*c*, 130*d* can have a geometry that differs with those of other docking regions in embodiments of the invention.

With continued reference to FIG. 3, each of the docking regions 130*a*, 130*b*, 130*c*, 130*d* can include an electrical interface 132*a*, 132*b*, 132*c*, 132*d* which can be attached to the circuit board 120. The circuit board 120 can be a printed circuit board (PCB), through which power and/or data can be transmitted to the various adapters. As shown in the illustrated embodiment, the electrical interfaces 132*a*, 132*b*, 132*c*, 132*d* can be in the form of sockets configured to receive plugs or prongs of an interchangeable adapter. This can allow an interchangeable adapter to be quickly and easily be coupled to the receiver 110 (i.e., "plug-and-play"). In some embodiments, the sockets can be keyed or registered to ensure that only compatible interchangeable adapters are used with the receiver 110. For example, the number of individual cavities in the sockets or the shape of the cavities themselves can be registered to receive only plugs or prongs of specific interchangeable adapters.

As shown in the illustrated embodiment, each of the electrical interfaces 132*a*, 132*b*, 132*c*, 132*d* can be include similar structure and/or positioning with respect to a particular docking region 130*a*, 130*b*, 130*c*, 130*d*. This can allow an operator to utilize each docking region 130*a*, 130*b*, 130*c*, 130*d* interchangeably. However, it is to be understood that the structure or positioning of electrical interfaces for different docking regions can vary to allow compatibility with a greater degree of interchangeable adapters. Moreover, while the electrical interfaces 132*a*, 132*b*, 132*c*, 132*d* are shown in the form of sockets, it is to be understood that other structures can be used such as plugs, prongs, pins, or contacts on the circuit board 120.

With continued reference to FIG. 3, four docking regions 130*a*, 130*b*, 130*c*, 130*d* can include retention mechanisms 134*a*, 134*b*, 134*c*, 134*d* for coupling to corresponding structures of an interchangeable adapter. The retention mechanisms 134*a*, 134*b*, 134*c*, 134*d* can enhance securement of an interchangeable adapter positioned in the docking regions 130*a*, 130*b*, 130*c*, 130*d*. In some embodiments, such as that shown, the retention mechanisms 134*a*, 134*b*, 134*c*, 134*d* can be used to supplement the physical coupling at the electrical interfaces 132*a*, 132*b*, 132*c*, 132*d* such as the illustrated sockets. This can reduce the likelihood of the interchangeable adapter being inadvertently removed from the receiver 110. For brevity, the structure of retention mechanism 134*a* will be described in further detail. It is to be understood that the structures described with respect to retention mechanism 134*a* can be utilized for other retention mechanisms, such as retention mechanisms 134*b*, 134*c*, 134*c*.

As shown in the illustrated embodiment, the retention mechanism 134*a* can include a plate 136*a*. The plate 136*a* can include a lip 138*a* extending from the plate 136*a* at or proximate a forward edge of the plate 136*a*. The lip 138*a* can engage one or more corresponding structures on the interchangeable adapters such as, but not limited to, hooks or slots. In some implementations, such as that shown in the illustrated embodiment, the lip 138*a* can include geometry which facilitates proper attachment of an interchangeable adapter to the receiver 110. For example, the geometry can be keyed or registered to corresponding features on the interchangeable adapter to reduce the likelihood of the interchangeable adapter being installed in a misaligned orientation. This can reduce potential damage to more fragile components of the receiver 110, such as the electrical interface 132*a*. Moreover, the register geometry can inhibit installation of interchangeable adapters which may be incompatible with the receiver 110, or at least the docking region 130*a*, which can also reduce the likelihood of damage to more fragile components. As shown in the illustrated embodiment, the lip 138*a* can include triangular cutouts 140*a* at opposite sides of the lip 138*a*; however, it is to be understood that other geometries can be used such as, but not limited to, circles, squares, slots, and the like. Moreover, it is to be understood that cutouts can be positioned along other portions of the lip 138*a*.

To facilitate coupling and decoupling of an interchangeable adapter with the retention mechanism 134*a*, the retention mechanism 134*a* can be movable from an engaged configuration to a disengaged configuration. In the engaged configuration, the retention mechanism 134*a* can be positioned to couple with a corresponding structure of the interchangeable adapter. In so doing, the retention mechanism 134*a* can secure the interchangeable adapter within the docking region 130*a* and reduce the likelihood that the interchangeable adapter is inadvertently removed from the docking region 130*a*. In the disengaged configuration, the retention mechanism 134*a* can be positioned to allow the interchangeable adapter to be removed from the docking region 130*a* or inserted into the docking region 130*a*. In some implementations, the plate 136*a* and lip 138*a* can be rotated and/or translated upwards relative to the position shown in FIG. 3. For example, the plate 136*a* can be rotatable about a pivot at or proximate a rearward edge of the plate 136*a*.

As shown in the illustrated embodiment, the plate 136*a* can be attached via one or more fasteners 142*a* to a cross-member 144 coupled to the frame 112. The cross-member 144 can be fixed relative to the frame 112 and the plate 136*a* can function as a cantilever about the fasteners 142*a*. The plate 136*a* can be formed from a resilient material that allows the plate 136*a* to be moved upward upon application of a modest amount of force (e.g., between about 1 $lb_f$ to about 20 $lb_f$, preferably between about 3 $lb_f$ to about 15 $lb_f$, and more preferably between about 5 $lb_f$ to about 10 $lb_f$). This ensures that the plate 136*a* can be intentionally moved relatively easily while still exerting sufficient force to secure the interchangeable adapter to the receiver 110 against inadvertent movement. In some embodiments, the plate 136*a* can be rotatably coupled to the frame 112 or cross-member 144 via a pivot (not shown). The retention member 134*a* can include one or more biasing members, such as a cantilever spring, coil spring, torsion spring, or the like, which can bias the retention member 134*a* towards the engaged configuration.

With reference next to FIG. 4, a left side-view of the receiver 110 is illustrated with a left sidewall of the frame 112 removed to illustrate internal components of the receiver 110. As shown in the illustrated embodiment, the receiver 110 can include one or more ports 150, 152, such as a USB port and a power port respectively. The one or more ports 150, 152 can be coupled to a circuit board 122 positioned behind (to left as shown in FIG. 4) circuit board 120. The receiver 110 can be electrically coupled to an inkjet refilling system via one or more ports, such as port 150 or other ports (not shown), to establish communications between the inkjet refilling system and the modular cartridge configuration system 100. This can allow the inkjet refilling system to control aspects of operation of the modular cartridge configuration system and vice-versa. For example, the modular cartridge configuration system can utilize some of the on-board processing power of the inkjet refilling system. The modular cartridge configuration system can be powered separately from the inkjet refilling system via a port 152, which can be a power port (e.g., a 5V power port). In some implementations, this can allow the modular cartridge configuration system to be operated separately from the inkjet refilling system. The receiver 110 can include a power switch 154 to control the on-off state of the modular cartridge configuration system. While two ports 150, 152 are shown, it is to be understood that a fewer number of ports or a greater number of ports can be used. For example, the receiver 110 and/or the interchangeable adapters can include additional ports, such as additional USB ports, which can allow for systems to communicate with the modular configuration system and/or allow for other types of functions to be performed, such as diagnostics.

First Interchangeable Adapter

Figure 5:
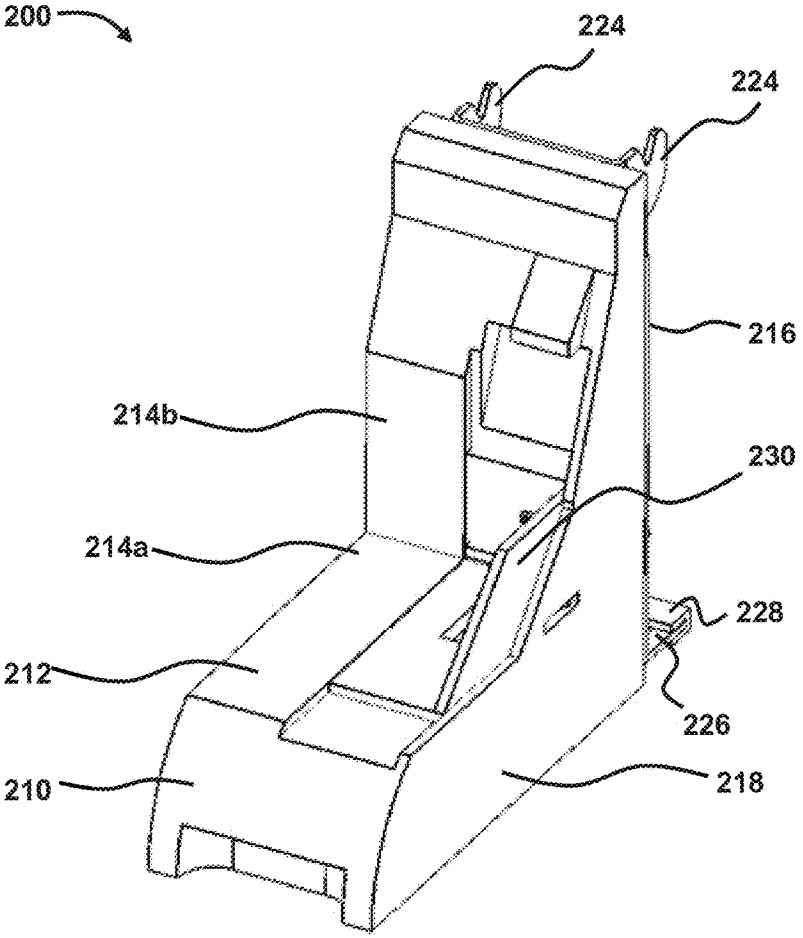
FIG. 5 is a front perspective view of a first interchangeable adapter of FIG. 2 shown in isolation of other components of the modular cartridge configuration system.
Figure 8:
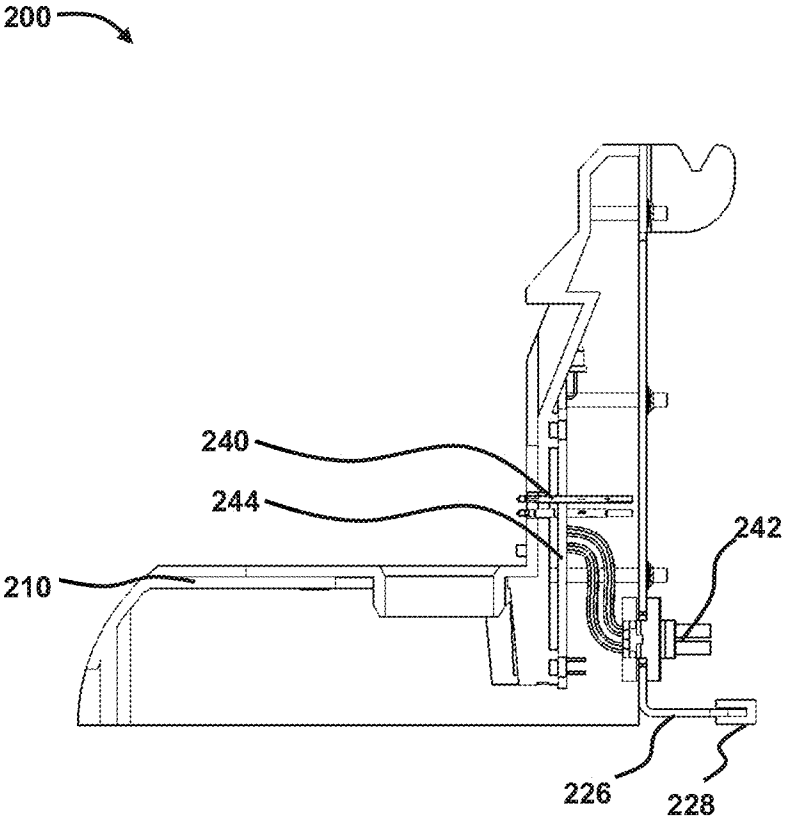
FIG. 8 is a right-side elevation side view of the first interchangeable adapter of FIG. 5 with portions removed to illustrate internal components.

With reference next to FIG. 5, the interchangeable adapter 200 is illustrated separate from its receiver. FIG. 5 illustrates a front perspective view of the interchangeable adapter 200, which can include a base 210. The base 210 can be used to support various components of the interchangeable adapter 200. The base 210 can include a support plate 212 generally sized and shaped to fit inkjet cartridges of a particular type (i.e., a family or series of inkjet cartridges). As shown in the illustrated embodiment, the support plate 212 can include a horizontally-oriented portion 214*a* and a vertically-oriented portion 214*b*. In some implementations, this geometry may match certain families or series of Epson® cartridges. The base 210 can also include a vertically oriented rear wall 216 and vertically oriented sidewalls 218 to house electronics (as shown in FIG. 8) within the base 210. For example, the vertically oriented rear wall 216 and vertically oriented sidewalls 218 can cover electronics within the base 210.

The interchangeable adapter 200 can include a support structure 230 sized and shaped to fit inkjet cartridges of a particular type (i.e., a different family or series of inkjet cartridges). The support structure 230 can be used to couple an inkjet cartridge (not shown) directly to the base 210. In some embodiments, such as that shown, the support structure 230 can be separate from the base 210. This can facilitate the manufacturing process. For example, the base 210 can be more generally sized and shaped to accommodate a wider range of inkjet cartridges while the support structure 230 is more specifically sized and shaped to accommodate a particular type of inkjet cartridge.

With continued reference to FIG. 5, the interchangeable adapter 200 can include one or more retention mechanisms 224 for coupling to corresponding structures of the receiver, such as retention mechanisms 134*a*, 134*b*, 134*c*, 134*d* (as shown in FIG. 3). The retention mechanisms 224 can enhance securement of the interchangeable adapter 200 to a docking region of the receiver, such as docking regions 130*a*, 130*b*, 130*c*, 130*d* (as shown in FIG. 3). In some embodiments, such as that shown, the retention mechanisms 224 can be used to supplement the physical coupling at an electrical interface between the receiver and the interchangeable adapter 200. This can reduce the likelihood of the interchangeable adapter 200 being inadvertently removed from the receiver.

As shown in the illustrated embodiment, the retention mechanisms 224 can include hooks with slots extending from the rear wall 216 of the base 210. The hooks can engage one or more corresponding structures on the receiver such as, but not limited to, lips 138*a*, 138*b*, 138*c*, 138*d* (as shown in FIG. 3). In some implementations, such as that shown in the illustrated embodiment, the retention mechanisms 224 can include geometry which facilitates proper attachment of the interchangeable adapter 200 to the receiver. For example, the geometry can be keyed or registered to corresponding features on the interchangeable adapter to reduce the likelihood that the interchangeable adapters are installed in a misaligned orientation. Moreover, the register geometry can inhibit installation of the interchangeable adapter 200 to an incompatible receiver, or at least an incompatible docking region of the receiver. As shown in the illustrated embodiment, the hooks can engage the keyed features of the lip. However, it is to be understood that other geometries for the retention mechanisms 224 can be used such as, but not limited to, protrusions, slots, recesses, and the like. Moreover, it is to be understood that retention mechanisms 224 can be positioned along other portions of the base 210.

As shown, the interchangeable adapter 200 can include other alignment features 226 to further facilitate alignment of the interchangeable adapter 200 with the receiver. For example, the alignment feature 226 can include a foot extending from the rear wall 216. The alignment feature 226 can be received within a recess of the receiver. In some embodiments, the alignment feature 226 can include a cover 228. The cover 228 can be formed from a material different (e.g., softer) than that of the base 210 to reduce the likelihood of damaging components of the receiver if an operator attempts to attach the interchangeable adapter 200 to the receiver in a misaligned orientation.

Figure 6:
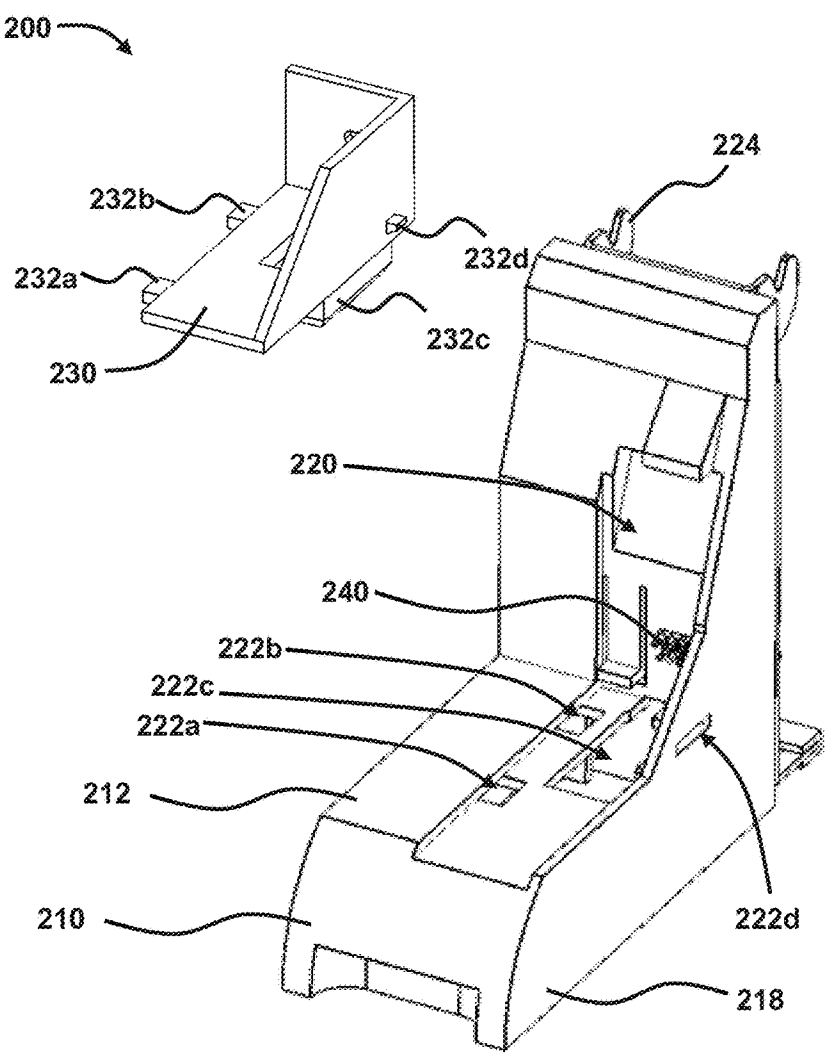
FIG. 6 is a front perspective view of the first interchangeable adapter of FIG. 5 with a support structure detached from a base.

FIG. 6 illustrates the interchangeable adapter 200 with the support structure 230 removed. As shown in FIG. 6, the support plate 212 of the base 210 can include a recessed area 220 sized to receive the support structure 230. In some embodiments, such as that shown, the base 210 can include geometry which facilitates proper attachment of the support structure 230 to the base 210. For example, the geometry can be keyed or registered to corresponding features on the support structure 230 to reduce the likelihood that the support structure 230 is installed in a misaligned orientation. Moreover, the register geometry can inhibit installation of support structures 230 which may be incompatible with the base 210. As shown in the illustrated embodiment, the base 210 can include one or more slots or cutouts 222*a*, 222*b*, 222*c* in the recessed area 220 as well as a slot or cutout 222*d* in the side wall 218 which can engage corresponding structures of the support structure 230. It is to be understood that other geometries and features can be used such as, but not limited to, protrusions, and can be positioned along other portions of the base 210.

The keyed features 222*a*, 222*b*, 222*c*, 222*d* can receive corresponding keyed or registered features 232*a*, 232*b*, 232*c*, 232*d* of the support structure 230 respectively to secure the support structure 230 to the base 210. In some embodiments, the support structure 230 can be removably coupled to the base 210 via these structures. In other implementations, the support 230 can be intended to be permanently coupled upon engagement of the keyed features 232*a*, 232*b*, 232*c*, 232*d* with corresponding keyed features 222*a*, 222*b*, 222*c*, 222*d* of the base 210.

The interchangeable adapter 200 can also include a cartridge interface 240 (e.g., an electrical or electro-mechanical interface) through which power and/or data can be transmitted from cartridge electronics, such as an original PLC or an existing customizable PLC. In some implementations, such as that shown in the illustrated embodiment, the cartridge interface 240 can include one or more contacts in the form of pogo connector pins sized and shaped to contact the cartridge electronics. This can allow an inkjet cartridge to be quickly and easily coupled to the interchangeable adapter 200. The number and orientation of the contacts can be based on the type of inkjet cartridge intended to be serviced with the interchangeable adapter. For example, in the illustrated embodiment, the cartridge interface 240 extends horizontally from a vertically oriented surface of the support plate 212. This can conform to particular types of inkjet cartridges such as certain families or series of Epson® cartridges. In some embodiments, the base 210 and/or support structure 230 can be sized and shaped such that the contacts of the inkjet cartridge are aligned with the cartridge interface 240 before the contacts of the inkjet cartridge are brought into contact with the cartridge interface 240. This can reduce side loads imposed on the cartridge interface 240 which may, in some implementations, be pogo connector pins. For example, the support structure 230 can be translated relative to the base 210 to allow the contacts of the inkjet cartridge to be brought into contact with the cartridge interface 240. In some embodiments, the support structure 230 can be inhibited from translating towards the cartridge interface 240 until the cartridge is properly aligned. While a cartridge interface 240 in the form of contacts has been illustrated, it is to be understood that other types of interfaces, such as a socket, can be used.

Figure 7:
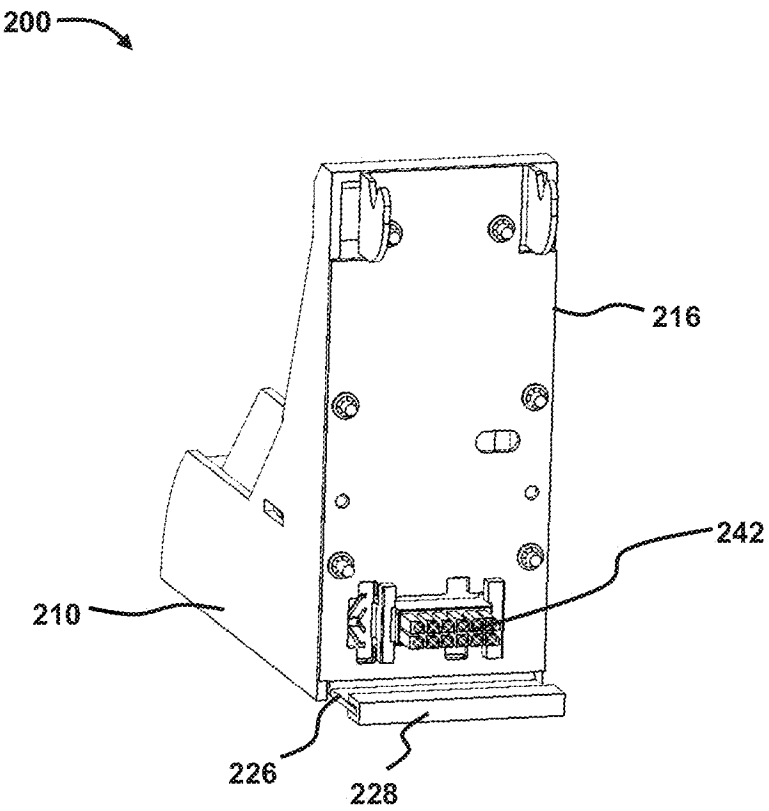
FIG. 7 is a rear perspective view of the first interchangeable adapter of FIG. 5.

FIG. 7 illustrates a rear perspective view of the interchangeable adapter 200, which can include a receiver interface 242 through which power and/or data can be transmitted. As shown in the illustrated embodiment, the receiver interface 242 can be in the form of plugs or prongs configured to be inserted into electrical interfaces in the form of sockets, such as electrical interfaces 132*a*, 132*b*, 132*c*, 132*d* of receiver 110 (as shown in FIG. 3). This can allow an interchangeable adapter 200 to be quickly and easily be coupled to the receiver (i.e., "plug-and-play"). In some implementations, the plugs or prongs can be keyed or registered to ensure that the interchangeable adapter 200 is used only with a compatible receiver. For example, the number of prongs or the shape of the prongs or plugs themselves can be registered to be inserted only into sockets of specific receivers. While a receiver interface 242 in the form of plugs or prongs has been illustrated, it is to be understood that other types of interfaces, such as a socket, can be used.

With reference next to FIG. 8, the interchangeable adapter 200 is illustrated with a sidewall of the base 210 and a sidewall of the support structure 230 removed to show internal components of the interchangeable adapter 200. As shown, the interchangeable adapter 200 can include a circuit board 244 to which the cartridge interface 240 and/or the receiver interface 242 can be electrically coupled. This can allow electronics of an inkjet cartridge to communicate with the receiver via the interchangeable adapter 200. In some embodiments, the electronics of the interchangeable adapter 200 can include an identification tag. The identification tag can be incorporated onto the interchangeable adapter 200 such that the receiver can read the identification tag via the receiver interface 242. Other types of identification tags can be incorporated. For example, it is to be understood that the interchangeable adapter 200 can include a bar code, magnetic field identifier (MFID), and/or a radio frequency identifier (RFID).

In some embodiments, the electronics of the interchangeable adapter 200 can include programming for the particular types of inkjet cartridges used with the interchangeable adapter 200. For example, the programming can include instructions for modifying an inkjet configuration, such as resetting an existing PLC and/or programming a customizable PLC. This programming can be incorporated into the circuit board 244, such as via an integrated circuit or chip.

Second Interchangeable Adapter

Figure 9:
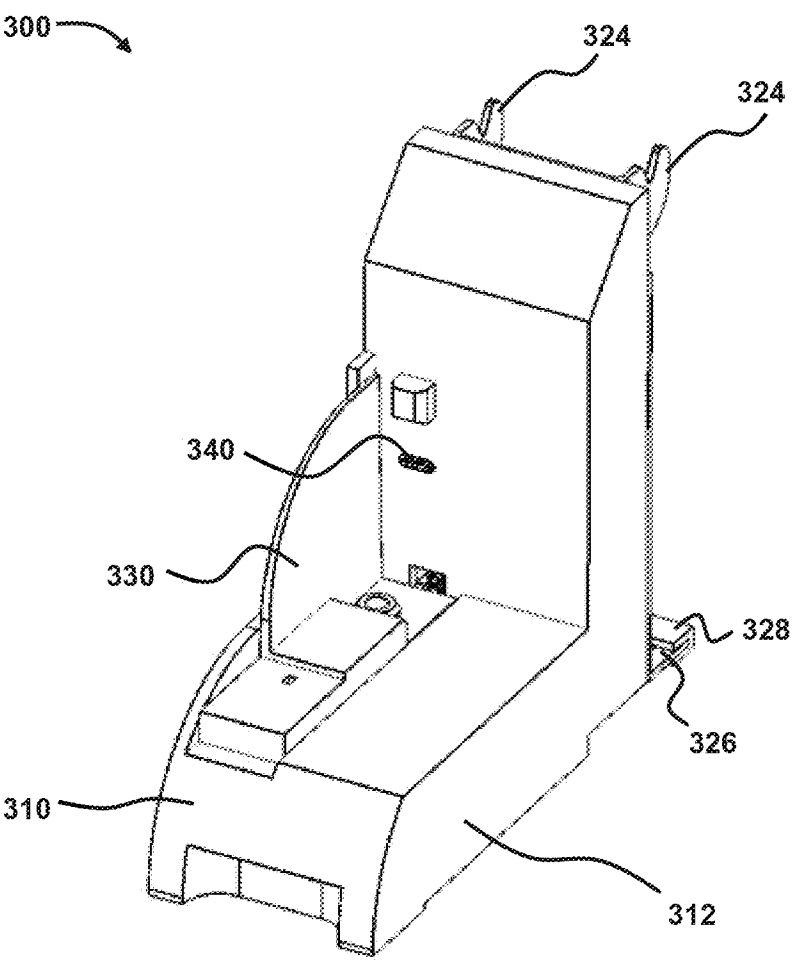
FIG. 9 is a front perspective view of a second interchangeable adapter of FIG. 2 shown in isolation of other components of the modular cartridge configuration system.

With reference next to FIG. 9, the interchangeable adapter 300 is illustrated separate from its receiver. The interchangeable adapter 300 can include components, structures, features and/or functionality which are the same or similar to those described above in connection with interchangeable adapter 200. Of course, it is to be understood that aspects of the interchangeable adapter 300 can differ from that of interchangeable adapter 200 to allow the interchangeable adapter 300 to be used with inkjet cartridges of a different type (i.e., a different family or series of inkjet cartridges) than the type of inkjet cartridges used with interchangeable adapter 200.

The interchangeable adapter 300 can include a base 310. The base 310 can be used to support various components of the interchangeable adapter 300. The base 310 can include a support plate 312 generally sized and shaped to fit inkjet cartridges of a particular type (i.e., a family or series of inkjet cartridges). In some embodiments, the geometry of the support plate 312 may match certain families or series of Brother® cartridges. The interchangeable adapter 300 can include a support structure 330 sized and shaped to fit inkjet cartridges of a particular type. The support structure 330 can be used to couple an inkjet cartridge (not shown) directly to the base 310.

The interchangeable adapter 300 can include a cartridge interface 340 (e.g., an electrical or electro-mechanical interface) through which power and/or data can be transmitted from cartridge electronics, such as an original PLC or an existing customizable PLC. In some embodiments, the cartridge interface 340 can include one or more contacts in the form of pogo connectors pins sized and shaped to contact the cartridge electronics. This can allow an inkjet cartridge to be quickly and easily be coupled to the interchangeable adapter 300. The number and orientation of the contacts can be based on the type of inkjet cartridge intended to be serviced with the interchangeable adapter. For example, in the illustrated embodiment, the cartridge interface 340 extends horizontally from a vertically oriented surface of the support plate 312. This can conform to particular types of inkjet cartridges, such as certain families or series of Brother® cartridges. In some embodiments, the base 310 and/or support structure 330 can be sized and shaped such that the contacts of the inkjet cartridge are aligned with the cartridge interface 340 before the contacts of the inkjet cartridge are brought into contact with the cartridge interface 340. This can reduce side loads imposed on the cartridge interface 340 which may, in some implementations, be pogo connector pins. For example, the support structure 330 can be translated relative to the base 310 to allow the contacts of the inkjet cartridge to be brought into contact with the cartridge interface 340. In some embodiments, the support structure 330 can be inhibited from translating towards the cartridge interface 340 until the cartridge is properly aligned. While a cartridge interface 340 in the form of contacts has been illustrated, it is to be understood that other types of interfaces, such as a socket, can be used.

Similar to the interchangeable adapter 200, the interchangeable adapter 300 can include a circuit board (not shown) to which the cartridge interface 240 and/or the receiver interface (not shown) can be electrically coupled. This can allow electronics of an inkjet cartridge to communicate with the receiver via the interchangeable adapter 300. In some embodiments, the electronics of the interchangeable adapter 300 can include an identification tag. The identification tag can be incorporated onto the interchangeable adapter 300 such that the receiver can read the identification tag via the receiver interface. Other types of identification tags can be incorporated. For example, it is to be understood that the interchangeable adapter 300 can include a bar code, magnetic field identifier (MFID), and/or a radio frequency identifier (RFID). The identification tag for the interchangeable adapter 300 can be different from that of interchangeable adapter 200 to allow the receiver to distinguish between the interchangeable adapters.

In some embodiments, the electronics of the interchangeable adapter 300 can include programming for the particular types of inkjet cartridges used with the interchangeable adapter 300. For example, the programming can include instructions for modifying an inkjet configuration, such as resetting an existing PLC and/or programming a customizable PLC. This programming can be incorporated into the circuit board, such as via an integrated circuit or chip.

As noted above, in some embodiments, the interchangeable adapter 300 can include components, structures, features and/or functionality which are the same or similar to those described above in connection with interchangeable adapter 200. This can allow the interchangeable adapter 300 to be used within the same docking region as the interchangeable adapter 200.

For example, the electrical communication features such as a receiver interface (not shown) can be similar to receiver interface 242 of the interchangeable adapter 200. This can allow the interchangeable adapter 300 to be used with the same electrical interface as the interchangeable adapter 200, such as electrical interfaces 132*a*, 132*b*, 132*c*, 132*d* of receiver 110 (as shown in FIG. 3). For example, in some embodiments, the receiver interface of interchangeable adapter 300 can be in the form of plugs or prongs configured to be inserted into electrical interfaces in the form of sockets. This can allow an interchangeable adapter 300 to be quickly and easily be coupled to the receiver (i.e., "plug-and-play"). In some embodiments, the plugs or prongs can be keyed or registered similarly to receiver interface 242. However, it is to be understood that in some embodiments, the plugs or prongs can be keyed differently from those of receiver interface 242. This can be in the event that interchangeable adapter 300 is incompatible with the electrical interface to which interchangeable adapter 200 is compatible.

As another example, the coupling features such as retention mechanisms 324 can be similar to retention mechanisms 224 of the interchangeable adapter 200. This can allow the interchangeable adapter 300 to be used with the same coupling and/or alignment features as the interchangeable adapter 200, such as retention mechanism 134*a*, 134*b*, 134*c*, 134*d* of receiver 110 (as shown in FIG. 3). For example, in some implementations such as that illustrated, the retention mechanisms 324 can include hooks with slots. The hooks can engage one or more corresponding structures on the receiver such as, but not limited to, lips 138*a*, 138*b*, 138*c*, 138*d* (as shown in FIG. 3). Similar to retention mechanisms 224, the retention mechanism 324 can include geometry which facilitates proper attachment of the interchangeable adapter 300 to the receiver. The hooks can engage the keyed features of the lip. However, it is to be understood that in some embodiments, the retention mechanisms 324 can be keyed differently from that of retention mechanisms 224. This can be in the event that interchangeable adapter 300 is incompatible with the docking region to which interchangeable adapter 200 is compatible.

Other alignment features, such as alignment feature 326, can be similar to alignment feature 226 of the interchangeable adapter 200. This can allow the interchangeable adapter 300 to be used in the same docking regions of the receiver as the interchangeable adapter 200. As shown, the alignment feature 326 can include a foot and a cover 328. The cover 328 can be formed from a material different (e.g., softer) than that of the base 310 to reduce the likelihood of damaging components of the receiver if an operator attempts to attach the interchangeable adapter 300 to the receiver in a misaligned orientation. However, it is to be understood that in some embodiments, the alignment feature 326 can be sized and/or shaped differently from that of alignment feature 226. This can be in the event that interchangeable adapter 300 is incompatible with the docking region to which interchangeable adapter 200 is compatible.

Figure 10:
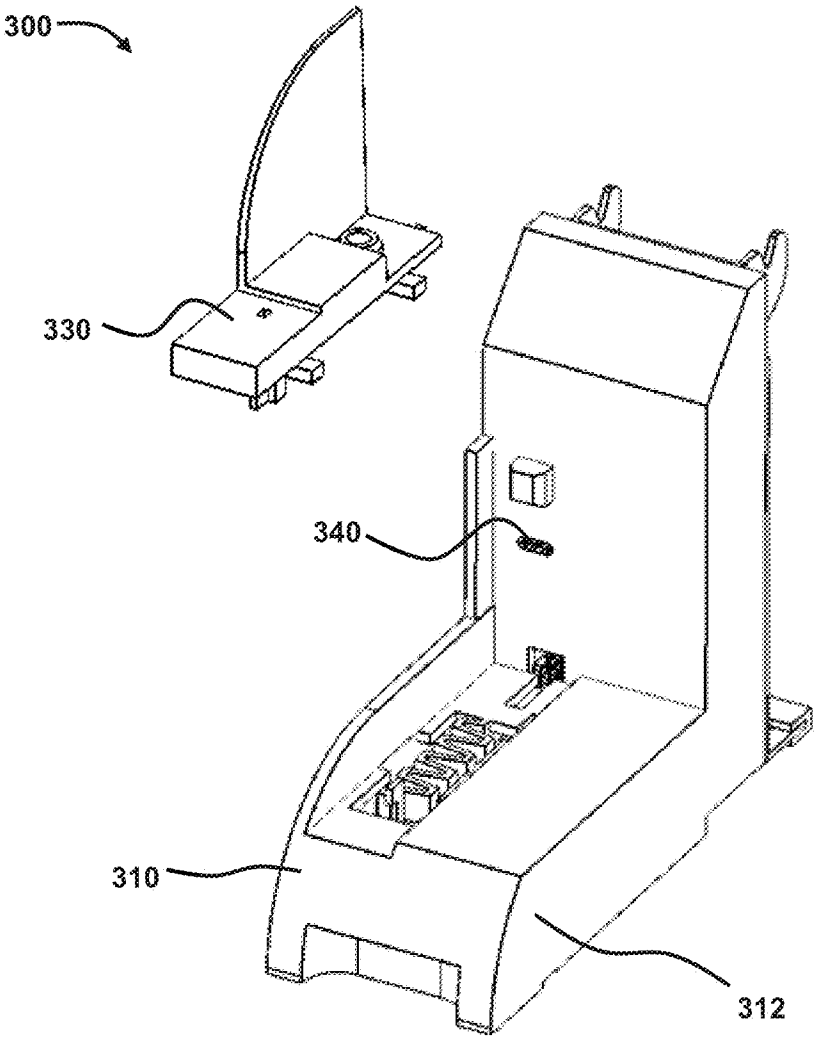
FIG. 10 is a front perspective view of the second interchangeable adapter of FIG. 9 with a support structure detached from a base.

As shown in FIG. 10, the support structure 330 can be separate from the base 310. This allows the interchangeable adapter 300 to be configurable such that other inkjet cartridges in the same family may be used within the interchangeable adapter 300 by simple modification of the size or shape of only the support structure 330. For example, making the support structure shorter or taller may allow other inkjet cartridges in the same family to fit within the interchangeable adapter 300.

Third Interchangeable Adapter

Figure 11:
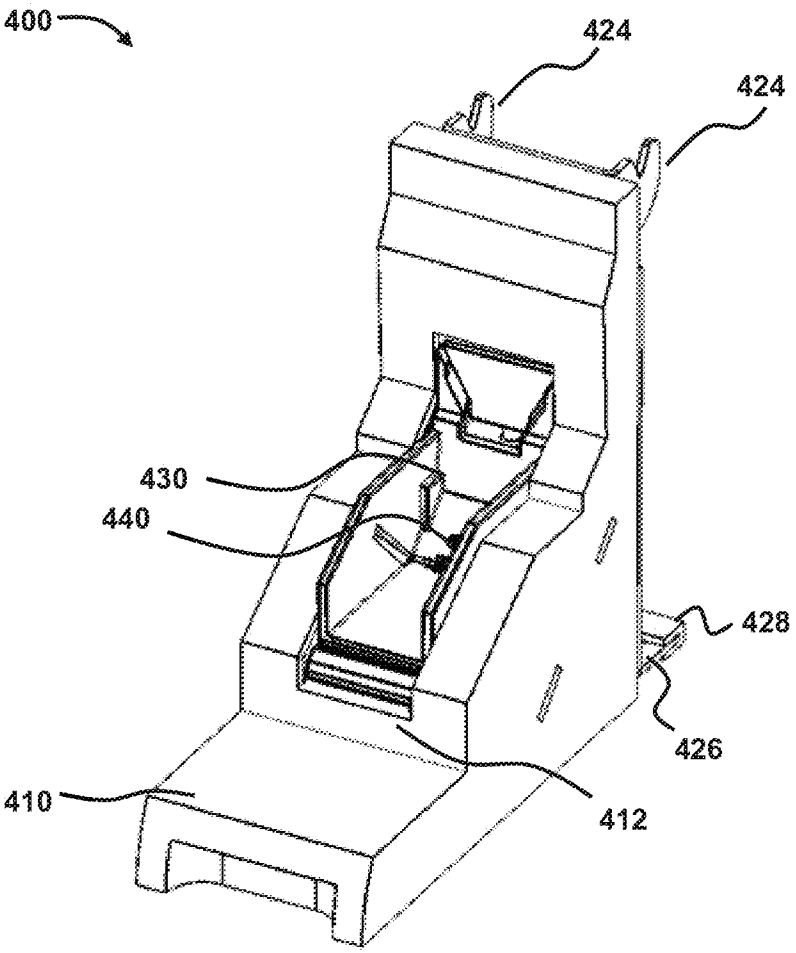
FIG. 11 is a front perspective view of a third interchangeable adapter of FIG. 2 shown in isolation of other components of the modular cartridge configuration system.

With reference next to FIG. 11, the interchangeable adapter 400 is illustrated separate from its receiver. The interchangeable adapter 400 can include components, structures, features and/or functionality which are the same or similar to those described above in connection with interchangeable adapters 200, 300. Of course, it is to be understood that aspects of the interchangeable adapter 400 can differ from that of interchangeable adapters 200, 300 to allow the interchangeable adapter 400 to be used with inkjet cartridges of a different type (i.e., a different family or series of inkjet cartridges) than the types of inkjet cartridges used with interchangeable adapters 200, 300.

The interchangeable adapter 400 can include a base 410. The base 410 can be used to support various components of the interchangeable adapter 400. The base 410 can include a support plate 412 generally sized and shaped to fit inkjet cartridges of a particular type (i.e., a family or series of inkjet cartridges). In some embodiments, the geometry of the support plate 412 may match certain families or series of Canon® cartridges. The interchangeable adapter 400 can include a support structure 430 sized and shaped to fit inkjet cartridges of a particular type. The support structure 430 can be used to couple an inkjet cartridge (not shown) directly to the base 410. In some embodiments, such as that shown, the support structure 430 can be separate from the base 410.

The interchangeable adapter 400 can include a cartridge interface 440 (e.g., an electrical or electro-mechanical interface) through which power and/or data can be transmitted from cartridge electronics, such as an original PLC or an existing customizable PLC. The cartridge interface 440 can include one or more contacts in the form of pogo connectors pins sized and shaped to contact the cartridge electronics. This can allow an inkjet cartridge to be quickly and easily be coupled to the interchangeable adapter 400. The number and orientation of the contacts can be based on the type of inkjet cartridge intended to be serviced with the interchangeable adapter. For example, in the illustrated embodiment, the cartridge interface 440 extends perpendicularly from an obliquely-oriented surface of the support plate 412. This can conform to particular types of inkjet cartridges, such as certain families or series of Canon® cartridges. In some embodiments, the base 410 and/or support structure 430 can be sized and shaped such that the contacts of the inkjet cartridge are aligned with the cartridge interface 440 before the contacts of the inkjet cartridge are brought into contact with the cartridge interface 440. This can reduce side loads imposed on the cartridge interface 440 which may, in some implementations, be pogo connector pins. For example, the support structure 430 can be translated perpendicular to the oblique surface of base 410 to allow the contacts of the inkjet cartridge to be brought into contact with the cartridge interface 440. In some embodiments, the support structure 430 can be inhibited from translating towards the cartridge interface 440 until the cartridge is properly aligned. While a cartridge interface 440 in the form of contacts has been illustrated, it is to be understood that other types of interfaces, such as a socket, can be used.

Similar to the interchangeable adapters 200, 300, the interchangeable adapter 400 can include a circuit board (not shown) to which the cartridge interface 440 and/or the receiver interface (not shown) can be electrically coupled. This can allow electronics of an inkjet cartridge to communicate with the receiver via the interchangeable adapter 400. In some embodiments, the electronics of the interchangeable adapter 400 can include an identification tag. The identification tag can be incorporated onto the interchangeable adapter 400 such that the receiver can read the identification tag via the receiver interface. Other types of identification tags can be incorporated. For example, it is to be understood that the interchangeable adapter 400 can include a bar code, magnetic field identifier (MFID), and/or a radio frequency identifier (RFID). The identification tag for the interchangeable adapter 400 can be different from that of interchangeable adapters 200, 300 to allow the receiver to distinguish between the interchangeable adapters.

In some embodiments, the electronics of the interchangeable adapter 400 can include programming for the particular types of inkjet cartridges used with the interchangeable adapter 400. For example, the programming can include instructions for modifying an inkjet configuration, such as resetting an existing PLC and/or programming a customizable PLC. This programming can be incorporated into the circuit board, such as via an integrated circuit or chip.

As noted above, in some embodiments, the interchangeable adapter 400 can include components, structures, features and/or functionality which are the same or similar to those described above in connection with interchangeable adapters 200, 300. This can allow the interchangeable adapter 400 to be used within the same docking region as the interchangeable adapters 200, 300.

For example, the electrical communication features such as a receiver interface (not shown) can be similar to receiver interfaces of the interchangeable adapters 200, 300, such as receiver interface 242 of the interchangeable adapter 200. This can allow the interchangeable adapter 400 to be used with the same electrical interface as the interchangeable adapters 200, 300, such as electrical interfaces 132*a*, 132*b*, 132*c*, 132*d* of receiver 110 (as shown in FIG. 3). For example, in some embodiments, the receiver interface of interchangeable adapter 400 can be in the form of plugs or prongs configured to be inserted into electrical interfaces in the form of sockets. This can allow an interchangeable adapter 400 to be quickly and easily be coupled to the receiver (i.e., "plug-and-play"). In some embodiments, the plugs or prongs can be keyed or registered similarly to receiver interface 242. However, it is to be understood that in some implementations, the plugs or prongs can be keyed differently from those of receiver interface 242. This can be in the event that interchangeable adapter 400 is incompatible with the electrical interface to which interchangeable adapters 200, 300 are compatible.

As another example, the coupling features such as retention mechanisms 424 can be similar to retention mechanisms 224, 324 of the interchangeable adapters 200, 300. This can allow the interchangeable adapter 400 to be used with the same coupling and/or alignment features as the interchangeable adapters 200, 300, such as retention mechanism 134*a*, 134*b*, 134*c*, 134*d* of receiver 110 (as shown in FIG. 3). For example, in some implementations such as that illustrated, the retention mechanisms 424 can include hooks with slots. The hooks can engage one or more corresponding structures on the receiver 110 such as, but not limited to, lips 138*a*, 138*b*, 138*c*, 138*d* (as shown in FIG. 3). Similar to retention mechanisms 224, 324, the retention mechanisms 424 can include geometry which facilitates proper attachment of the interchangeable adapter 400 to the receiver. The hooks can engage the keyed features of the lip. However, it is to be understood that in some implementations, the retention mechanisms 424 can be keyed differently from that of retention mechanisms 224, 324. This can be in the event that interchangeable adapter 400 is incompatible with the docking region to which interchangeable adapters 200, 300 are compatible.

Other alignment features, such as alignment feature 426, can be similar to alignment features 226, 326 of the interchangeable adapters 200, 300. This can allow the interchangeable adapter 400 to be used in the same docking regions of the receiver as the interchangeable adapters 200, 300. As shown, the alignment feature 426 can include a foot and a cover 428. The cover 428 can be formed from a material different (e.g., softer) than that of the base 410 to reduce the likelihood of damaging components of the receiver if an operator attempts to attach the interchangeable adapter 400 to the receiver in a misaligned orientation. However, it is to be understood that in some implementations, the alignment feature 426 can be sized and/or shaped differently from that of alignment features 226, 326. This can be in the event that interchangeable adapter 400 is incompatible with the docking region to which interchangeable adapters 200, 300 are compatible.

Figure 12:
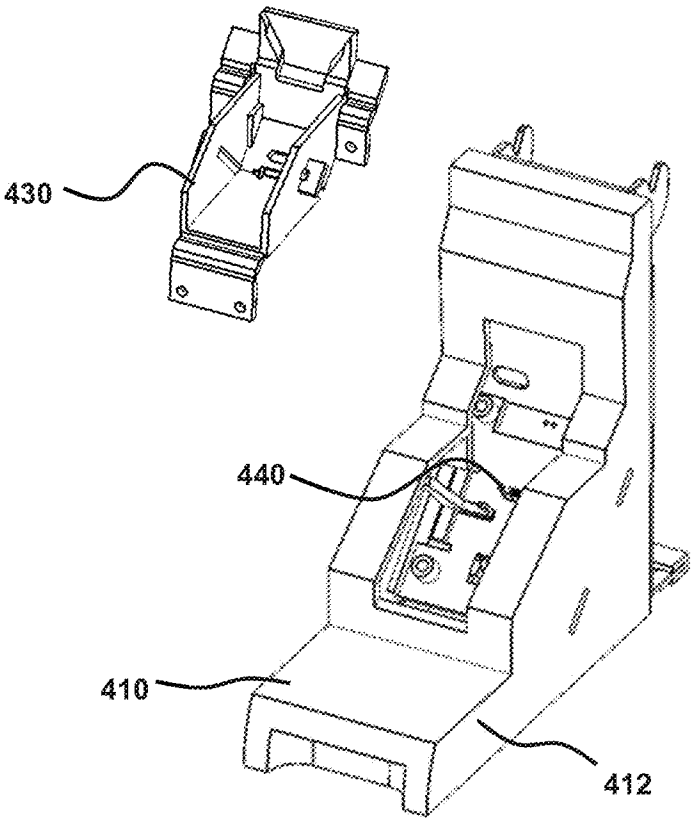
FIG. 12 is a front perspective view of the third interchangeable adapter of FIG. 11 with a support structure detached from a base.

As shown in FIG. 12, the support structure 430 can be separate from the base 410. This allows the interchangeable adapter 400 to be configurable such that other inkjet cartridges in the same family may be used within the interchangeable adapter 400 by simple modification of the size or shape of only the support structure 430. For example, making the support structure shorter or taller may allow other inkjet cartridges in the same family to fit within the interchangeable adapter 400.

Fourth Interchangeable Adapter

Figure 13:
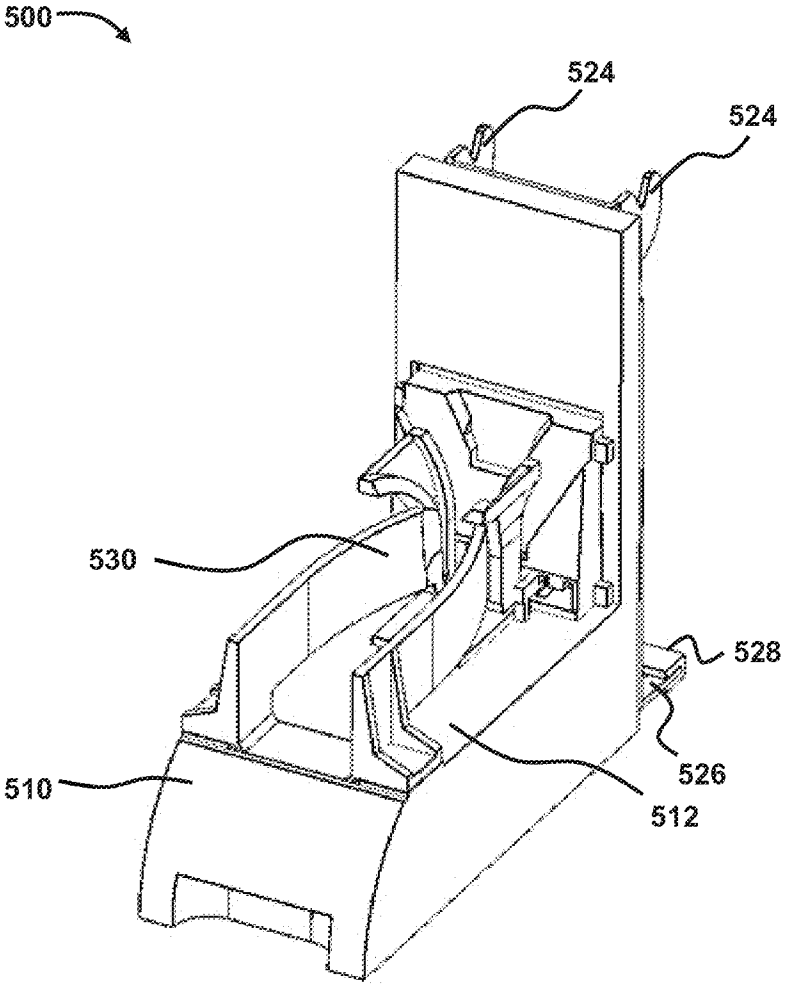
FIG. 13 is a front perspective view of a fourth interchangeable adapter of FIG. 2 shown in isolation of other components of the modular cartridge configuration system.

With reference next to FIG. 13, the interchangeable adapter 500 is illustrated separate from its receiver. The interchangeable adapter 500 can include components, structures, features and/or functionality which are the same or similar to those described above in connection with interchangeable adapters 200, 300, 400. Of course, it is to be understood that aspects of the interchangeable adapter 500 can differ from that of interchangeable adapters 200, 300, 400 to allow the interchangeable adapter 500 to be used with inkjet cartridges of a different type (i.e., a different family or series of inkjet cartridges) than the types of inkjet cartridges used with interchangeable adapters 200, 300, 400.

The interchangeable adapter 500 can include a base 510. The base 510 can be used to support various components of the interchangeable adapter 500. The base 510 can include a support plate 512 generally sized and shaped to fit inkjet cartridges of a particular type (i.e., a family or series of inkjet cartridges). In some embodiments, the geometry of the support plate 512 may match certain families or series of Canon® cartridges. The interchangeable adapter 500 can include a support structure 530 sized and shaped to fit inkjet cartridges of a particular type. The support structure 530 can be used to couple an inkjet cartridge (not shown) directly to the base 510. In some embodiments, such as that shown, the support structure 530 can be separate from the base 510.

Figure 14:
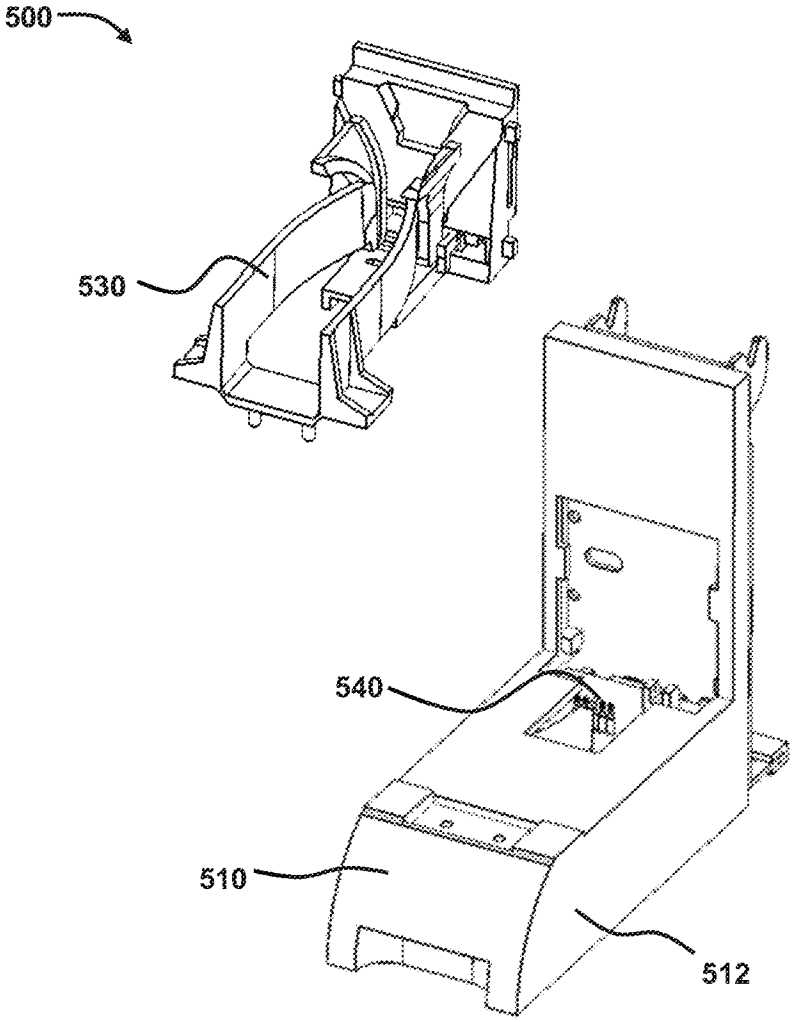
FIG. 14 is a front perspective view of the fourth interchangeable adapter of FIG. 13 with support structures detached from a base.

The interchangeable adapter 500 can include a cartridge interface 540 (e.g., an electrical or electro-mechanical interface), as shown in FIG. 14, through which power and/or data can be transmitted from cartridge electronics, such as an original PLC or an existing customizable PLC. The cartridge interface 540 can include one or more contacts in the form of pogo connectors pins sized and shaped to contact the cartridge electronics. This can allow an inkjet cartridge to be quickly and easily be coupled to the interchangeable adapter 500. The number and orientation of the contacts can be based on the type of inkjet cartridge intended to be serviced with the interchangeable adapter. For example, in the illustrated embodiment, the cartridge interface 540 extends vertically and is positioned at or proximate a horizontally-oriented portion of the support plate 512. This can conform to particular types of inkjet cartridges, such as certain families or series of Canon® cartridges. In some embodiments, the base 510 and/or support structure 530 can be sized and shaped such that the contacts of the inkjet cartridge are aligned with the cartridge interface 540 before the contacts of the inkjet cartridge are brought into contact with the cartridge interface 540. This can reduce side loads imposed on the cartridge interface 540 which may, in some implementations, be pogo connector pins. For example, the support structure 530 can be translated relative to the base 510 to allow the contacts of the inkjet cartridge to be brought into contact with the cartridge interface 540. In some embodiments, the support structure 530 can be inhibited from translating towards the cartridge interface 540 until the cartridge is properly aligned. While a cartridge interface 540 in the form of contacts has been illustrated, it is to be understood that other types of interfaces, such as a socket, can be used.

Similar to the interchangeable adapters 200, 300, 400, the interchangeable adapter 500 can include a circuit board (not shown) to which the cartridge interface 540 and/or the receiver interface (not shown) can be electrically coupled. This can allow electronics of an inkjet cartridge to communicate with the receiver via the interchangeable adapter 500. In some implementations, the electronics of the interchangeable adapter 500 can include an identification tag. The identification tag can be incorporated onto the interchangeable adapter 500 such that the receiver can read the identification tag via the receiver interface. Other types of identification tags can be incorporated. For example, it is to be understood that the interchangeable adapter 500 can include a bar code, magnetic field identifier (MFID), and/or a radio frequency identifier (RFID). The identification tag for the interchangeable adapter 500 can be different from that of interchangeable adapters 200, 300, 400 to allow the receiver 110 to distinguish between the interchangeable adapters.

In some embodiments, the electronics of the interchangeable adapter 500 can include programming for the particular types of inkjet cartridges used with the interchangeable adapter 500. For example, the programming can include instructions for modifying an inkjet configuration, such as resetting an existing PLC and/or programming a customizable PLC. This programming can be incorporated into the circuit board, such as via an integrated circuit or chip.

As noted above, in some embodiments, the interchangeable adapter 500 can include components, structures, features and/or functionality which are the same or similar to those described above in connection with interchangeable adapters 200, 300, 400. This can allow the interchangeable adapter 500 to be used within the same docking region as the interchangeable adapters 200, 300, 400.

For example, the electrical communication features such as a receiver interface (not shown) can be similar to receiver interfaces of the interchangeable adapters 200, 300, 400 such as receiver interface 242 of the interchangeable adapter 200. This can allow the interchangeable adapter 500 to be used with the same electrical interface as the interchangeable adapters 200, 300, such as electrical interfaces 132*a*, 132*b*, 132*c*, 132*d* of receiver 110 (as shown in FIG. 3). For example, in some embodiments, the receiver interface of interchangeable adapter 500 can be in the form of plugs or prongs configured to be inserted into electrical interfaces in the form of sockets. This can allow an interchangeable adapter 500 to be quickly and easily be coupled to the receiver (i.e., "plug-and-play"). In some embodiments, the plugs or prongs can be keyed similarly to receiver interface 242. However, it is to be understood that in some implementations, the plugs or prongs can be keyed differently from those of receiver interface 242. This can be in the event that interchangeable adapter 500 is incompatible with the electrical interface to which interchangeable adapters 200, 300, 400 are compatible.

As another example, the coupling features such as retention mechanisms 524 can be similar to retention mechanisms 224, 324, 424 of the interchangeable adapters 200, 300, 400. This can allow the interchangeable adapter 500 to be used with the same coupling and/or alignment features as the interchangeable adapters 200, 300, 400, such as retention mechanism 134*a*, 134*b*, 134*c*, 134*d* of receiver 110 (as shown in FIG. 3). For example, in some embodiments such as that illustrated, the retention mechanisms 524 can include hooks with slots. The hooks can engage one or more corresponding structures on the receiver 110 such as, but not limited to, lips 138*a*, 138*b*, 138*c*, 138*d* (as shown in FIG. 3). Similar to retention mechanisms 224, 324, 424, the retention mechanisms 524 can include geometry which facilitates proper attachment of the interchangeable adapter 500 to the receiver 110. As shown in the illustrated embodiment, the hooks can engage keyed features of the lip. However, it is to be understood that in some embodiments, the retention mechanisms 524 can be keyed differently from that of retention mechanisms 224, 324, 424. This can be in the event that interchangeable adapter 500 is incompatible with the docking region to which interchangeable adapters 200, 300, 400 are compatible.

Other alignment features, such as alignment feature 526, can be similar to alignment features 226, 326, 426 of the interchangeable adapters 200, 300 400. This can allow the interchangeable adapter 500 to be used in the same docking regions of the receiver as the interchangeable adapters 200, 300, 400. As shown, the alignment feature 526 can include a foot and a cover 528. The cover 528 can be formed from a material different (e.g., softer) than that of the base 510 to reduce the likelihood of damaging components of the receiver if an operator attempts to attach the interchangeable adapter 500 to the receiver in a misaligned orientation. However, it is to be understood that in some implementations, the alignment feature 526 can be sized and/or shaped differently from that of alignment features 226, 326, 426. This can be in the event that interchangeable adapter 500 is incompatible with the docking region to which interchangeable adapters 200, 300, 400 are compatible.

As shown in FIG. 14, the support structure 530 can be separate from the base 510. This allows the interchangeable adapter 500 to be configurable such that other inkjet cartridges in the same family may be used within the interchangeable adapter 500 by simple modification of the size or shape of only the support structure 530. For example, making the support structure shorter or taller may allow other inkjet cartridges in the same family to fit within the interchangeable adapter 500.

Method for Attaching Interchangeable Adapters

Figure 15:
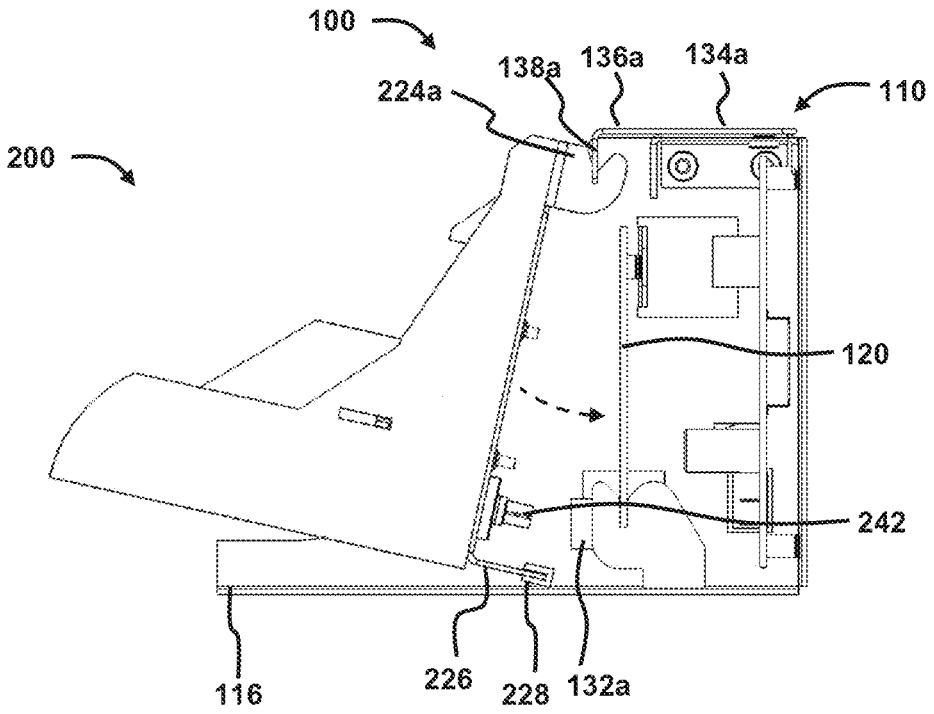
FIG. 15 is a right-side cross sectional view of the receiver and first interchangeable adapter for FIG. 2, shown in a detached configuration.
Figure 16:
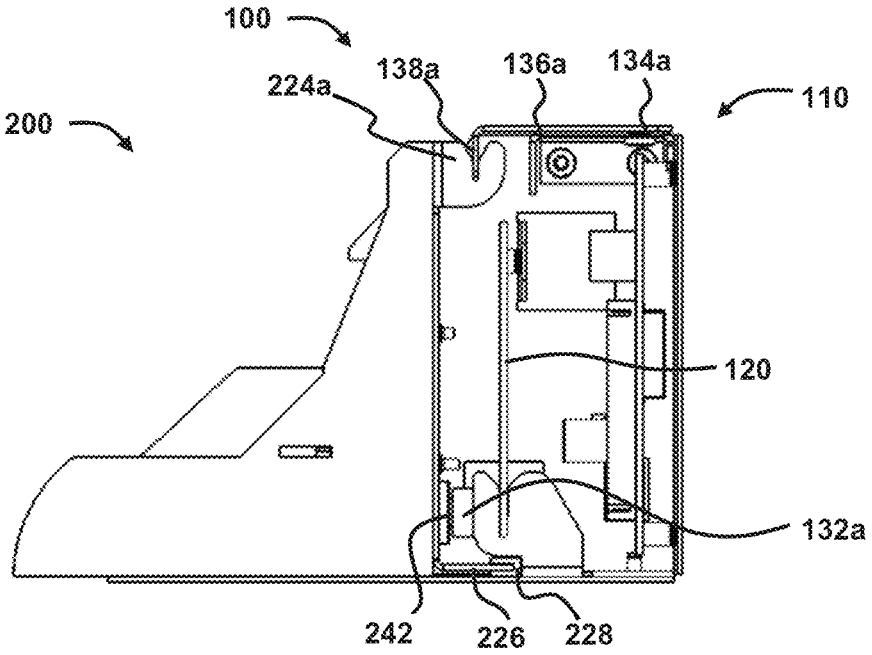
FIG. 16 is a right-side cross sectional view of the receiver and first interchangeable adapter for FIG. 15, shown in an attached configuration.

With reference next to FIGS. 15 and 16, a method of coupling the interchangeable adapter 200 with the receiver 110 is illustrated. Both FIGS. 15 and 16 are side-views of a cross-section along a line separating docking regions 130*a*, 130*b* (as shown in FIG. 3).

As shown in FIG. 15, the interchangeable adapter 200 is detached from the receiver 110. The interchangeable adapter 200 can be advanced towards the receiver 110. The retention mechanism 224*a* of the interchangeable adapter 200 can be brought into contact with the lip 138*a* of the retention mechanism 134*a* and can be advanced towards the receiver 110. For example, in some instances such as that shown in the illustrated embodiment, the interchangeable adapter 200 can be rotated towards the receiver 110. As the cover 228 of the interchangeable adapter 200 contacts the floor 116, at least a lip 138*a* of the retention mechanism 134*a* can be displaced upwards by the retention mechanism 224*a* of the interchangeable adapter 200 thereby allowing the interchangeable adapter 200 to be rotated further towards the receiver 110. That is, the retention mechanism 134*a* can be displaced into the disengaged configuration. The retention mechanism 134*a* can then be biased back downwards toward the engaged configuration, as the tip of the foot 228 passes directly below the contact point at 138*a*, and as the interchangeable adapter 200 is further rotated towards the receiver 110 and ultimately coupled to the receiver 110. This can secure the interchangeable adapter 200 to the receiver 110. This can facilitate installation of interchangeable adapters 200 into the receiver 110 by allowing an operator to install the interchangeable adapters 200 via a single motion. However, it is to be understood that the operation can differ from that described above. For example, an operator can install the interchangeable adapter 200 by first pulling the retention mechanism 134*a* upwards towards a disengaged configuration prior to advancing the interchangeable adapter 200 towards the receiver 110. The operator can then allow the retention mechanism 134*a* to return back to the engaged position or, in embodiments where the retention mechanism 134*a* is not biased, manually move the retention mechanism 134*a* back towards the engaged position.

As shown in FIG. 16, the interchangeable adapter 200 is attached to the receiver 110. In this engaged position, the retention mechanism 134*a* of the receiver 110 can engage the corresponding retention mechanism 224*a* of the interchangeable adapter 200. The receiver interface 242 of the interchangeable adapter 200 can be positioned in contact with the electrical interface 132*a* of the receiver 110. For example, in some implementations such as that shown in the illustrated embodiment, plugs or prongs of the receiver interface 242 can be received within a socket of electrical interface 132*a*. The alignment feature 226 of the interchangeable adapter 200 can be positioned beneath the circuit board 120 of the receiver 110.

While the modular system 100 illustrated in FIGS. 1-16 include components designed to allow for horizontal coupling of interchangeable adapters to a receiver, it is to be understood that other configurations can be used. For example, the electrical interface of the receiver and receiver interface of the interchangeable adapter can be positioned along a horizontally extending surface to allow for vertical coupling of interchangeable adapters to a receiver.

Method for Modifying the Inkjet Cartridge Configuration

Figure 17:
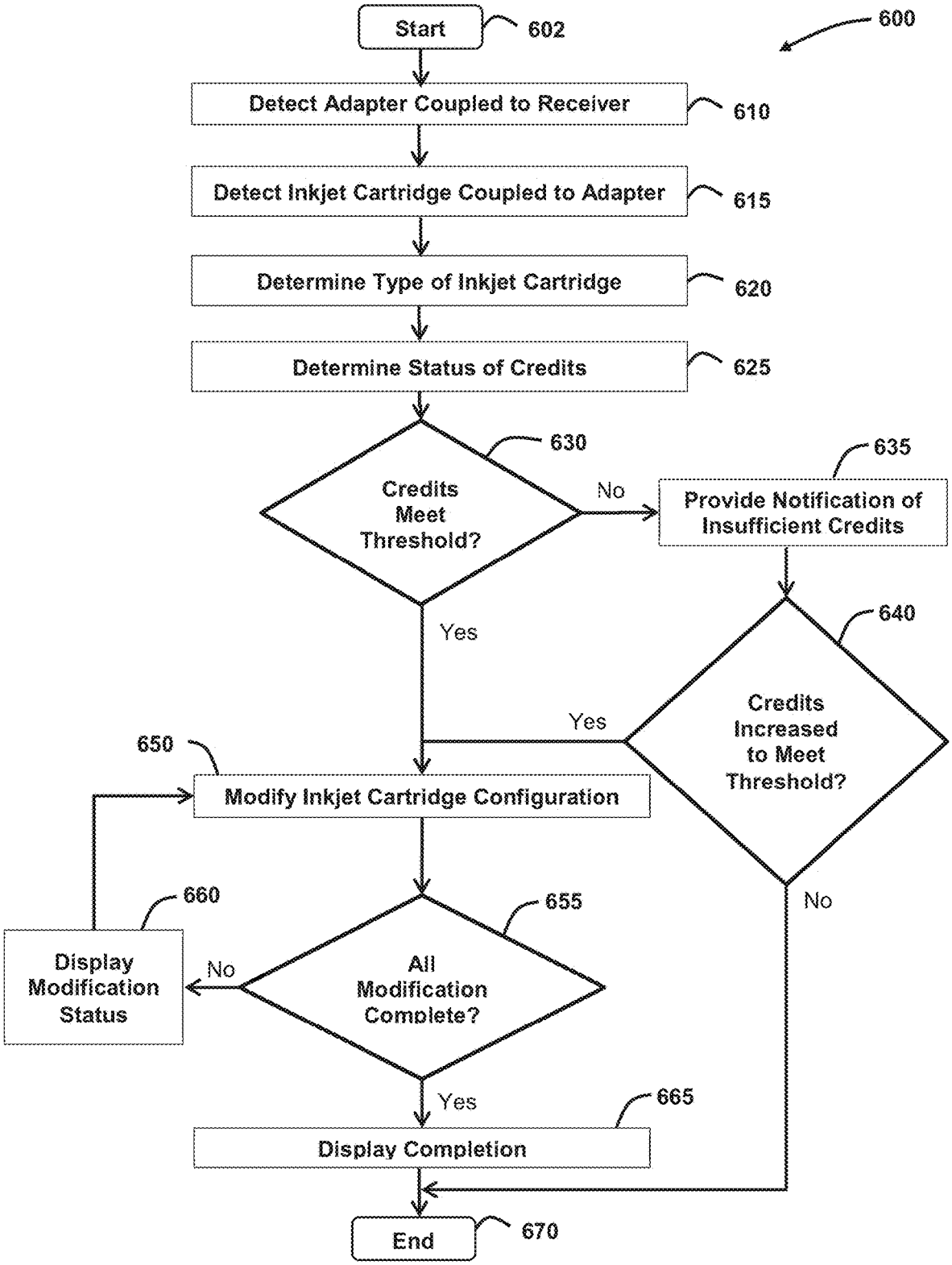
FIG. 17 is a flow diagram of an embodiment for modifying an inkjet cartridge configuration.

Referring now to FIG. 17, a flowchart of an embodiment of a method 600 for modifying an inkjet cartridge configuration using a modular configuration modification system, such as modular system 100, is shown. The method 600 as described herein may be employed after using the other components of the refilling system 10 as described above and shown in FIG. 1; however, the order of this sequence can be reversed, with the refilling system 10 being utilized after, or in between, any of the steps described in method 600. In some embodiments, one goal of the configuration modification method 600 is to reset an existing PLC or to reprogram a new customizable PLC; however, in other embodiments the method 600 may be used to configure other electronics of the inkjet cartridge.

In some embodiments, the system and method 600 described below is an integrated part of the inkjet refilling system 10 which can include the modular cartridge configuration system 100 attached thereto. In other embodiments, the method 600 can be implemented in a standalone version of the modular cartridge configuration system 100. For example, the method 600 can be implemented on the modular cartridge configuration system 100 without connecting the modular cartridge configuration system 100 to the inkjet refilling system 10. For purposes of the disclosure below, the method 600 will be described in connection with inkjet refilling system 10 which can include the modular cartridge configuration system 100. However, it is to be understood that in some embodiments the method may instead be performed by the modular cartridge configuration system 100 separately from the inkjet refilling system 10.

The method 600 can start at block 602 and move to block 610 where the inkjet refilling system detects whether an interchangeable adapter, such as interchangeable adapter 200, has been coupled to the receiver, such as receiver 110. The system can perform this process by exchanging electrical signals to and from the interchangeable adapter. For example, the system can transmit electrical signals to and from the interchangeable adapter via an interface, such as receiver interface 242, which can be electrically coupled to an interface of the receiver, such as electrical interface 132*a*. In some embodiments, the system can detect the adapter coupled to the receiver as soon as a circuit is formed at one of the docking regions, such as docking regions 130*a*, 130*b*, 130*c*, 130*d*.

Optionally, upon detecting coupling of an interchangeable adapter to the receiver, the system can determine the type of interchangeable adapter attached to the receiver. In some embodiments, the system can determine the type of interchangeable adapter based on detection of an identification tag of the interchangeable adapter. In instances where the identification tag is implemented as part of the electronics of the interchangeable adapter, the system can detect the identification tag by exchanging electrical signals to and from the interchangeable adapter. In embodiments where the system determines the type of interchangeable adapter installed, aspects of the system can be modified based on the type of interchangeable adapter. For example, a user interface, such as user interface 70, can be updated to display information pertinent to the interchangeable adapter such as, but not limited to, a status of credentials which is described in further detail below.

The method 600 can then move to block 615 where the inkjet refilling system detects whether an inkjet cartridge has been coupled to the interchangeable adapter, such as interchangeable adapter. The system can perform this process by exchanging electrical signals to and from electronics, such as a PLC, on the inkjet cartridge. For example, the system can transmit electrical signals to and from the inkjet cartridge via interfaces on the interchangeable adapter and the receiver.

The method 600 can then move to block 620 where the inkjet refilling system determines the type of inkjet cartridge attached to the receiver. In some embodiments, the system can determine the type of inkjet cartridge based on detection of identification information from the electronics, such as a PLC, on the inkjet cartridge. This identification information can be obtained from the electronics during the detection step described in block 615. In some embodiments, the system can determine the type of inkjet cartridge based on detection of one or more identification tags of the interchangeable adapter to which the inkjet cartridge is attached. This identification tag can be pulled from the interchangeable adapter during the optional detection step described in connection with block 610.

In some embodiments, the system can modify an inkjet configuration only if certain credentials are available. For example, the credentials can include credits which can be expended each time an inkjet configuration modification is performed. In such an embodiment, the method 600 can then move to block 625 where the inkjet refilling system 10 determines the status of these credentials. In instances where the credentials are credits, the system 10 can determine credit information for the particular inkjet cartridge. For example, the system 10 can obtain credit information from a database which is locally stored in memory residing within the modular system (e.g., on an interchangeable adapter or the receiver), locally stored in memory residing within other components of the system, or stored offsite.

The method 600 can then move to block 630 where a determination is made as to whether or not the proper credentials are received. In instances where the credentials are credits, the inkjet refilling system can determine whether these credits meet or exceed a threshold to modify the inkjet configuration. In some embodiments, the system can compare the number of credits with a threshold amount. For example, the system can pull the threshold amount from a database which is locally stored in memory residing within the modular system (e.g., on an interchangeable adapter or the receiver), locally stored in memory residing within other components of the system, or stored offsite.

Should the inkjet refilling system determine that proper credentials have not been met, the method 600 can move to block 635. The system can provide a prompt to the operator, such as via a user interface, indicating the current credentials and the required credentials. In some embodiments where the credentials are credits, the system can provide the operator with an option to increase the number of credits. For example, the system can provide the operator with a prompt on the user interface providing one or more options, such as a purchase, to increase the number of credits. In the event that an operator chooses to increase the number of credits, the system can process the request for additional credits. In some instances, the system can communicate with an offsite source (e.g., an offsite server) which handles the transaction and transfers these credits to the system. For example, a database which stores credit information can be updated (e.g., increased) based on the transaction.

The method 600 can then move to block 640 where the inkjet refilling system determines whether proper credentials exist after having provided a notification to the operator at block 635. In embodiments where the credentials are credits, the system can determine whether the number of credits increased after provision of the prompt to the operator or whether the operator declined the opportunity to increase the number of credits. Should the system detect an increased number of credits, the system can then compare the increased number of credits with the threshold amount in a manner similar to that performed at block 630.

Should the operator have declined the opportunity to increase the number of credits or the inkjet refilling system determines that the number of credits still does not meet or excess the threshold, the method 600 can move to block 670 thereby ending the method 600. In some embodiments, the method 600 can provide an error prompt to the operator. This error prompt can provide an indication that the inkjet cartridge configuration has not been modified.

Should the inkjet refilling system determine that the number of credits meets or exceeds the threshold at either blocks 630 or 640, the method can proceed to step 650. The system can proceed with modifying the inkjet cartridge configuration. In some embodiments, the system can begin modifying the inkjet cartridge configuration as soon as the system determines that sufficient credits exist. In other embodiments, the system does not start modifying the inkjet cartridge configuration until the operator initiates the procedure such as via a user interface. The system can modify the inkjet cartridge configuration by exchanging electrical signals to and from electronics, such as a PLC, on the inkjet cartridge. For example, the system can transmit electrical signals to and from the inkjet cartridge via interfaces on the interchangeable adapter and the receiver.

In instances where an existing PLC is being reused on the inkjet cartridge, the system can reset the inkjet cartridge configuration. This ensures that the serviced inkjet cartridge is usable when replaced within an inkjet printer. For example, the system can reset the PLC so that the PLC is recognized as being new or full by the inkjet printer. In some embodiments, the system can delete an existing configuration on the PLC and reprogram the configuration of the PLC to a state similar to that when the PLC was originally manufactured. In some embodiments, the system can reset "fill level" functionality on the PLC.

In instances where a new, customizable PLC is added to the inkjet cartridge, the system can program the inkjet cartridge configuration. A unique set of programmed instructions is communicated to the customizable PLC, thus configuring that PLC for use with one particular inkjet cartridge SKU. In some embodiments, the PLC contains a basic configuration specific for a particular cartridge family or series. In other embodiments, the PLC has no configuration information, or a limited configuration information, and the configuration step consists of downloading a more complete configuration to provide for full PLC functionality and configuration. The specific PLC SKU information, that is, the configuration indicative of the cartridge's color, ink volume, size and/or type, is transmitted to the PLC on the inkjet cartridge using a methodology that can be unique to each PLC manufacturer. This configuration, after downloaded to a generic configurable PLC, allows the PLC to respond correctly to the various queries of the inkjet cartridge by the inkjet printer about the inkjet cartridge's type, size, color, ink level, etc. In one embodiment, this PLC SKU configuration information is a binary code. In other embodiments, this PLC SKU configuration information is sent via ASCII, hexadecimal, or other communication schema. Further details pertaining to programming a new, customizable PLC can be found in U.S. Pat. No. 8,602,536 entitled "Programming Customizable Smart-Chip in an Ink Refilling Station," issued Dec. 10, 2013, the entirety of which has been incorporated by reference herein.

The method 600 can then move to block 655 where a determination is made as to whether or not the modification of the inkjet cartridge configuration is complete. Should the inkjet refilling system determine that modifications have not yet been completed, the method 600 can move to block 660 in which the system can display the status of the modification. For example, the system can display a progress bar on a user interface. The method 600 can then return to block 650 to continue modification of the inkjet cartridge configuration. Should the system determine that modifications have been completed, the method 600 can move to block 665 in which the system can display completion of the modification process. For example, the system can display such information on a user interface 70 and may provide a notice to the operator that the inkjet cartridge can be safely removed. The system can then move to block 670 thereby ending the method 600. In some embodiments, the system can apply the requisite number of credits for the modification. For example, a database which stores credit information can be updated (e.g., decreased) based on the applied number of credits.

It is to be understood that the steps of method 600 can be interchanged. Moreover, it is to be understood that one or more of the steps of method 600 can be omitted. For example, in some embodiments, the system can apply the requisite number of credits before, or during, modification of the inkjet cartridge configuration at block 650. As another example, in embodiments where credentials are not required to modify the inkjet cartridge configuration, the method 600 can omit any of steps 625, 630, 635, 640. In such an embodiment, the method 600 can immediately move from determining the type of inkjet cartridge at block 620 to modifying the inkjet cartridge configuration at block 650. It is also to be understood that additional steps may be added to method 600. For example, the method 600 can include steps in which the system verifies operability of one or more of the receiver, interchangeable adapter, and/or the inkjet cartridge.

Other Embodiments

While certain embodiments have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope of the disclosure. Accordingly, the scope of the present disclosure is defined only by reference to the claims presented herein or as presented in the future.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a sub combination.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A method for modifying configuration information stored on an inkjet cartridge via a modular system having a receiver and one or more interchangeable adapters, the method comprising:

detecting a first electronic coupling between an interchangeable adapter and the receiver;

detecting a second electronic coupling between an inkjet cartridge and the interchangeable adapter;

determining a type of the inkjet cartridge based on the first and second electronic couplings; and modifying configuration information stored on the inkjet cartridge based on the determined type of inkjet cartridge.

2. The method of claim 1, wherein determining the type of inkjet cartridge comprises detecting an identification tag of the interchangeable adapter based on the first electronic coupling.

3. The method of claim 1, wherein determining the type of inkjet cartridge comprises detecting identification information on electronics of the inkjet cartridge based on the second electronic coupling.

4. The method of claim 1, wherein the method comprises determining credits based on the determined type of inkjet cartridge.

5. The method of claim 4, wherein the method comprises displaying credits on a user interface.

6. The method of claim 4, wherein the method comprises applying credits based on the determined type of inkjet cartridge.

* * * * *